US007096834B2

(12) United States Patent
Yuasa et al.

(10) Patent No.: US 7,096,834 B2
(45) Date of Patent: Aug. 29, 2006

(54) TWO-CYCLE COMBUSTION ENGINE

(75) Inventors: Tsuneyoshi Yuasa, Kobe (JP); Masanori Kobayashi, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 11/033,660

(22) Filed: Jan. 11, 2005

(65) Prior Publication Data

US 2005/0155563 A1 Jul. 21, 2005

(30) Foreign Application Priority Data

Jan. 16, 2004 (JP) ..... 2004-008755

(51) Int. Cl.
*F02B 25/00* (2006.01)

(52) U.S. Cl. ..... 123/73 PP

(58) Field of Classification Search ..... 123/73 PP, 123/73 A

See application file for complete search history.

(56) References Cited

U.S. PATENT DOCUMENTS 6,591,793 B1 * 7/2003 Nemoto et al. ..... 123/73 PP 6,634,326 B1 * 10/2003 Radel et al. ..... 123/73 PP

FOREIGN PATENT DOCUMENTS

JP 2000-136755 5/2000

* cited by examiner

*Primary Examiner*—Henry C. Yuen
*Assistant Examiner*—Hyder Ali

(57) ABSTRACT

To provide a two-cycle combustion engine of a simplified structure with the number of component parts reduced, which is effective to suppress a blow-off of the air/fuel mixture and is excellent in acceleration, the two-cycle combustion engine includes scavenging passages communication between a combustion chamber and a crank chamber, an air/furl mixture passage for introducing an air/fuel mixture from a fuel supply device to the crank chamber, and a branch passage ramified off from the air/fuel mixture passage for supplying a lean air/fuel mixture into the scavenging passages. During an intake stroke, the lean air/fuel mixture from the branch passage is introduced into the scavenging passages and the air/fuel mixture is introduced from the air/fuel mixture passage into the crank chamber. During a scavenging stroke, the lean air/fuel mixture is supplied from the scavenging passages into the combustion chamber prior to introduction of the air/fuel mixture.

14 Claims, 15 Drawing Sheets

TWO-CYCLE COMBUSTION ENGINE

BACKGROUND OF THE INVENTION

1. Field of the Invention

The present invention relates to a two-cycle combustion engine for use mainly as a drive source for a small-size work machine such as, for example, a brush cutter.

2. Description of the Prior Art

It is conventional in a two-cycle combustion engine that, prior to scavenging of the combustion chamber with an air/fuel mixture, initial scavenging of the combustion chamber with air is carried out to suppress a blow-off of the air/fuel mixture through an exhaust port (see, for example, Japanese Laid-open Patent Publication No. 2000-136755). This known two-cycle combustion engine makes use of a carburetor of a type including an air flow passage, having an air control valve built therein, and an air/fuel mixture passage extending parallel to the air flow passage and having an air/fuel mixture control valve built therein. In this known construction, during an intake stroke of the engine, the air/fuel mixture can be introduced from the air/fuel mixture passage in the carburetor into a crank chamber through an air/fuel mixture passage in a intake tube and an air/fuel mixture supply passage in a cylinder block and, at the same time, an air can be introduced from the air flow passage in the carburetor into a scavenging passage in the cylinder block through an air passage in the intake tube, an air supply tube and a coupling tube. On the other hand, during a scavenging stroke the air is initially introduced into the scavenging passage, prior to introduction of the air/fuel mixture into the combustion chamber, to perform a leading scavenging to thereby suppress the blow-off of the air/fuel mixture through the exhaust passage.

It has, however, been found that since in the prior art two-cycle combustion engine, the carburetor includes therein the air flow passage and the air/fuel mixture passage having the air control valve and the air/fuel mixture control valve built therein, respectively, the carburetor tends to be complicated in structure and expensive. Also, two reed valves are required in the prior art two-cycle combustion engine in order to block an inflow of the combustion gases into the coupling tube, resulting in increase of the component parts used and, hence, increase of the cost of manufacture. Also, since in the prior art two-cycle combustion engine the leading scavenging is carried out by the utilization of air, the timing at which the air/fuel mixture is subsequently introduced into the combustion chamber tends to delay or too much air tends to be sucked, eventually resulting in lack of acceleration.

SUMMARY OF THE INVENTION

In view of the foregoing, the present invention is intended to provide a two-cycle combustion engine of a simplified structure with the number of component parts reduced, which is effective to suppress a blow-off of the air/fuel mixture and is excellent in acceleration.

In order to accomplish the foregoing objects, the present invention provides a two-cycle combustion engine which includes at least one scavenging passage communicating between a combustion chamber, delimited by a piston, and a crank chamber, an air/furl mixture passage for introducing an air/fuel mixture from a fuel supply device to the crank chamber, and a branch passage ramified off from the air/fuel mixture passage for supplying a lean air/fuel mixture, which is lean as compared with the air/fuel mixture in the air/fuel mixture passage, into the scavenging passage. In this two-cycle combustion engine, during an intake stroke of the engine, the lean air/fuel mixture from the branch passage is introduced into the scavenging passage and the air/fuel mixture is introduced from the air/fuel mixture passage into the crank chamber, but during a scavenging stroke of the engine, the lean air/fuel mixture is supplied from the scavenging passage into the combustion chamber prior to introduction of the air/fuel mixture within the crank chamber into the combustion chamber through the scavenging passage.

According to the present invention, since the air/fuel mixture passage and the branch passage are employed, the fuel supply device such as a carburetor suffices to have a passage for the flow of an air/fuel mixture and no passage for the flow of air is needed. Accordingly, the fuel supply device can have a simplified structure and can be manufactured at a reduced cost. Also, since prior to the introduction of the air/fuel mixture into the combustion chamber the lean air/fuel mixture is introduced into the combustion chamber, the blow-off of the air/fuel mixture can be prevented. Also, bearings and other movable parts can be effectively lubricated by the air/fuel mixture introduced directly into the crank chamber.

Furthermore, since in place of the air used in the prior art two-cycle combustion engine to scavenge the combustion chamber, the lean air/fuel mixture introduced into the scavenging passage is utilized to initially scavenge the combustion chamber, a favorable acceleration performance can be appreciated as compared with the leading scavenging with the air. In addition, considering that the lean air/fuel mixture used to accomplish the leading scavenging evolves a large latent heat of vaporization as compared with the air, it can bring about a high effect of cooling an upper region of the cylinder block and the fuel contained in the lean air/fuel mixture can be promptly atomized by the heat evolving in the cylinder block, resulting in increase of the efficiency of combustion.

In a preferred embodiment of the present invention, a check valve may be disposed in the branch passage for permitting only flow of the lean air/fuel mixture therethrough towards the scavenging passage. The use of the check valve allows a sufficient amount of the lean air/fuel mixture for use in scavenging to be secured within the scavenging passage since whenever a reed valve is opened during the intake stroke, in which a negative pressure is developed inside the crank chamber, the lean air/fuel mixture is introduced into the scavenging passage.

In another preferred embodiment of the present invention, at least a downstream region of the branch passage may be formed in a cylinder block. According to this feature, since the branch passage is fluidly connected with the scavenging passage through a downstream region provided in the cylinder block, neither the air supply tube nor the connecting tube, both of which have hitherto required in the prior art combustion engine of the similar kind, is needed in the two-cycle combustion engine according to the present invention, resulting in further reduction in cost of manufacture.

In a further preferred embodiment of the present invention, the piston may have a peripheral wall formed with at least one suction chamber, so that during the intake stroke the suction chamber can be communicated with the branch passage to allow the lean air/fuel mixture to be introduced from the branch passage into the scavenging passage through the suction chamber.

According to the formation of the suction chamber in the peripheral wall of the piston, neither the reed valve, the air supply tube nor the connecting tube, all of which have hitherto been required in the prior art two-cycle engine, is needed and, therefore, the structure can be simplified, accompanied by reduction in cost.

In a still further preferred embodiment of the present invention, the scavenging passage may be employed in two pairs, in which case the branch passage is fluidly connected with one of the pairs of the scavenging passages. The two pairs of the scavenging passages include a pair of first scavenging passages and a pair of second scavenging passage, and the second scavenging passages are preferably positioned at respective locations closer to an exhaust port than the first scavenging passages and the branch passage is preferably fluidly connected with the pair of the second scavenging passages. By so designing, the air/fuel mixture entering from the first scavenging passages into the combustion chamber can be blocked by the lean air/fuel mixture introduced from the second scavenging passages into the combustion chamber, prior to the introduction of the air/fuel mixture from the first scavenging passages into the combustion chamber, and drifting at a location adjacent the exhaust port and, therefore, the blow-off of the air/fuel mixture through the exhaust port can be further effectively suppressed.

In a still further preferred embodiment of the present invention, the branch passage may be branched off from the air/fuel mixture passage so as to extend in a direction substantially perpendicular to the air/fuel mixture passage. By so doing, the fuel particles contained in the air/fuel mixture flowing through the air/fuel mixture passage can be effectively separated by the action of the inertia force of flow and, therefore, the sufficiently lean air/fuel mixture can be introduced into the branch passage.

The fuel supply device may include a single air/fuel mixture supply passage for supplying the air/fuel mixture into the air/fuel mixture passage. According to this structure the fuel supply device can be simplified in structure.

The branch passage referred to above may be disposed above the air/fuel mixture passage, so that fuel particles contained in the air/fuel mixture flowing through the air/fuel mixture passage can be effectively separated from the air/fuel mixture by the action of not only an inertia force of flow thereof, but also the gravity and, therefore, the sufficiently lean air/fuel mixture can be introduced into the branch passage.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, preferred embodiments of the present invention will be described in detail with reference to the accompanying drawings.

Figure 1:
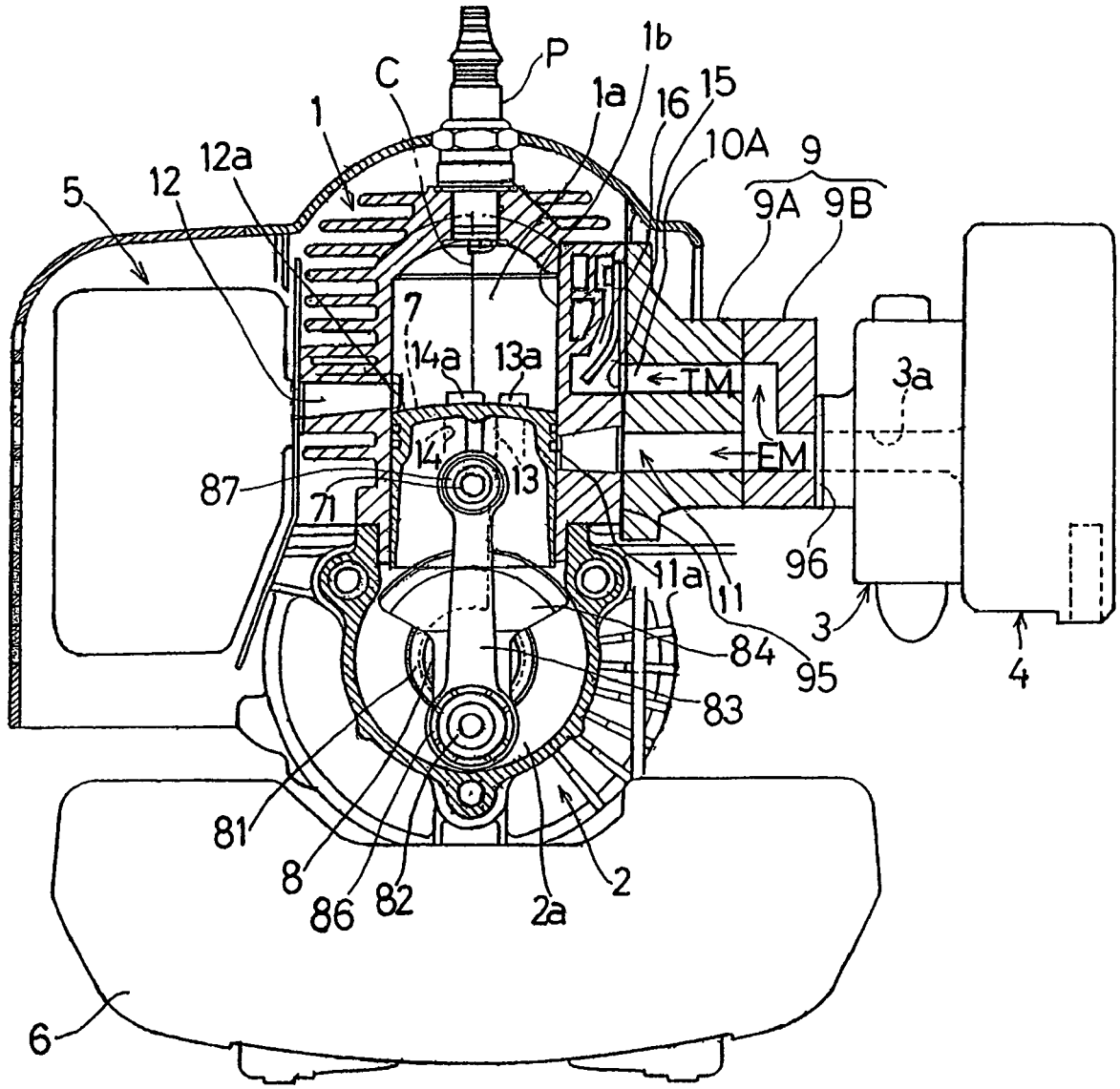
FIG. 1 is a transverse sectional view, with a portion cut out, of a two-cycle internal combustion engine according to a first preferred embodiment of the present invention.

Referring first to FIG. 1, showing a transverse sectional view of a two-cycle combustion engine according to a first preferred embodiment of the present invention, shown with a portion thereof cut out. As shown therein, the combustion engine includes a cylinder block 1 having a cylinder bore 1*b* defined therein and an ignition plug P mounted atop the cylinder block 1, and a crankcase 2 having a crank chamber 2*a* defined therein with the cylinder block 1 being fixedly mounted thereon. The cylinder block 1 and the crankcase 2 are both made of a metallic material such as, for example, aluminum and formed by the use of any known casting mold assembly.

A carburetor 3 and an air cleaner unit 4, forming respective parts of an air intake system of the two-cycle internal combustion engine are fluidly connected with a side wall portion, for example, a right side wall portion of the cylinder block 1 while a muffler 5 forming a part of an exhaust system of the same engine is fluidly connected with a left side wall portion of the cylinder block 1. A fuel tank 6 is secured to a bottom region of the crankcase 2. The cylinder bore 1*b* in the cylinder block 1 accommodates therein a piston 7 for reciprocating movement in a direction axially thereof, which piston 7 cooperates with the cylinder bore 1*b* to define a capacity-variable combustion chamber 1*a* immediately above the piston 7. The combustion chamber 1*a* and the crank chamber 2*a* are separated or partitioned by the piston 7.

A crankshaft 8 is rotatably supported within the crankcase 2 by means of crankshaft bearings 81. This crankshaft 8 has a longitudinal axis about which it rotates and also has an eccentric portion offset laterally from the longitudinal axis thereof and having a hollow crank pin 82 mounted thereon. The crankshaft 8 is drivingly coupled with the piston 7 by means of a connecting rod 83, which connects between the crank pin 82 and a hollow piston pin 71, carried by the piston 7, through a large diameter end bearing 86 on the crank pin 82 and a small diameter end bearing 87 on the piston pin 71. The crankshaft 8 also includes a pair of crank webs 84 so as to lie generally perpendicular to the longitudinal axis of the crankshaft 8.

An insulator 9 is connected at one side with the cylinder block 1 and at the other side with the carburetor 3, with sealing gaskets 95 and 96 intervening between it and the cylinder block 1 and between it and the carburetor 3, respectively. This insulator 9 is utilized for insulating heats emanating from the cylinder block 1 and includes first and second insulator blocks 9A and 9B jointed together. With the first and second insulator blocks 9A and 9B jointed together, the insulator 9 has its interior formed with an air/fuel mixture passage 11 and a branch passage 10A branched off from the air/fuel mixture passage 11. The air/fuel mixture passage 11 is communicated straight with a single air/fuel mixture supply passage 3*a* of the carburetor 3 so that an air/fuel mixture EM flowing through the air/fuel mixture supply passage 3*a* can be introduced directly into the crank chamber 2*a* defined in the crankcase 2.

The branch passage 10A referred to above has an upstream end portion ramified upwardly from an upstream region of the air/fuel mixture passage 11 in a direction substantially perpendicular to the air/fuel mixture passage 11, that is, communicated with the upstream region of the air/fuel mixture passage 11 so as to extend substantially perpendicular thereto. The branch passage 10A so branched off from the air/fuel mixture passage 11 also has a downstream portion lying perpendicular to the upstream end portion thereof so as to extend substantially parallel to the air/fuel mixture passage 11 at a location above the air/fuel mixture passage 11. Accordingly, the branch passage 10A is operable to introduce into second scavenging passages 14 as will be described later, a portion of the air/fuel mixture EM drawn from the air/fuel mixture EM flowing within the air/fuel mixture passage 11. That portion of the air/fuel mixture introduced into the second scavenging passages 14 through the branch passage 10A is leaned by a separating action brought about by an inertia force of the air/fuel mixture EM flowing within the air/fuel mixture passage 11 as compared with the air/fuel mixture EM flowing within the air/fuel mixture passage 11. The respective amounts of the air/fuel mixture EM and a lean air/fuel mixture TM separated from the air/fuel mixture EM are regulated by the carburetor 3 so that when the air/fuel mixture EM and the lean air/fuel mixture TM are eventually mixed within the combustion chamber 1*a*, an optimum combustion of the air/fuel mixture can take place within the combustion chamber 1*a*.

The carburetor 3 includes a single rotary valve (not shown) for adjusting the cross-sectional area of the air/fuel mixture supply passage 3*a*. Also, the cylinder block 1 has an exhaust passage 12 defined in the cylinder wall and communicated with the combustion chamber 1*a* through an exhaust port 12*a* that is defined in an inner peripheral surface of the cylinder block 1 so as to open towards the cylinder bore. As a matter of course, exhaust gases (burned gases) are exhausted to the outside through this exhaust passage 12 by way of the muffler 5.

Figure 2:
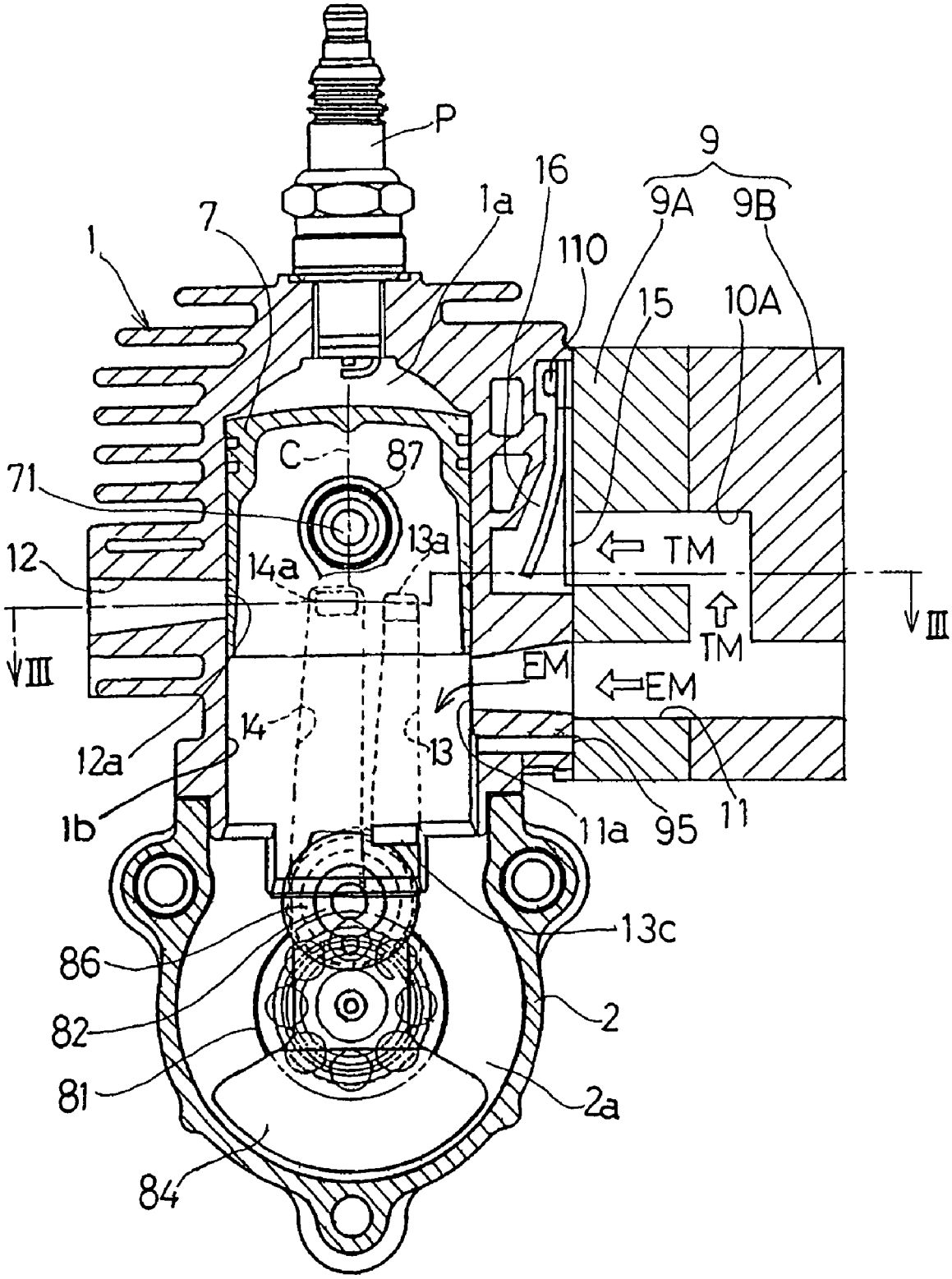
FIG. 2 is a transverse sectional view of the two-cycle internal combustion engine, showing an engine cylinder and a crankcase on an enlarged scale.

As best shown in FIG. 2 showing the cylinder block 1 and the crankcase 2 on an enlarged cross-sectional front view, a pair of first scavenging passages 13 for communicating the combustion chamber 1*a* directly with the crank chamber 2*a* are defined in part within the cylinder block 1 and in part within the wall of the crankcase 2 so as to extend in a direction generally parallel to a longitudinal axis C of the cylinder bore. Similarly, a pair of second scavenging passages 14 for communicating the combustion chamber 1*a* with the crank chamber 2*a* through the crank shaft bearings 81 are defined in part within the cylinder block 1 and in part within the wall of the crankcase 2 so as to extend in a direction generally parallel to the longitudinal axis C of the cylinder bore and are positioned on one side of the pair of the first scavenging passages 13 adjacent the exhaust port 12*a*.

Figure 3:
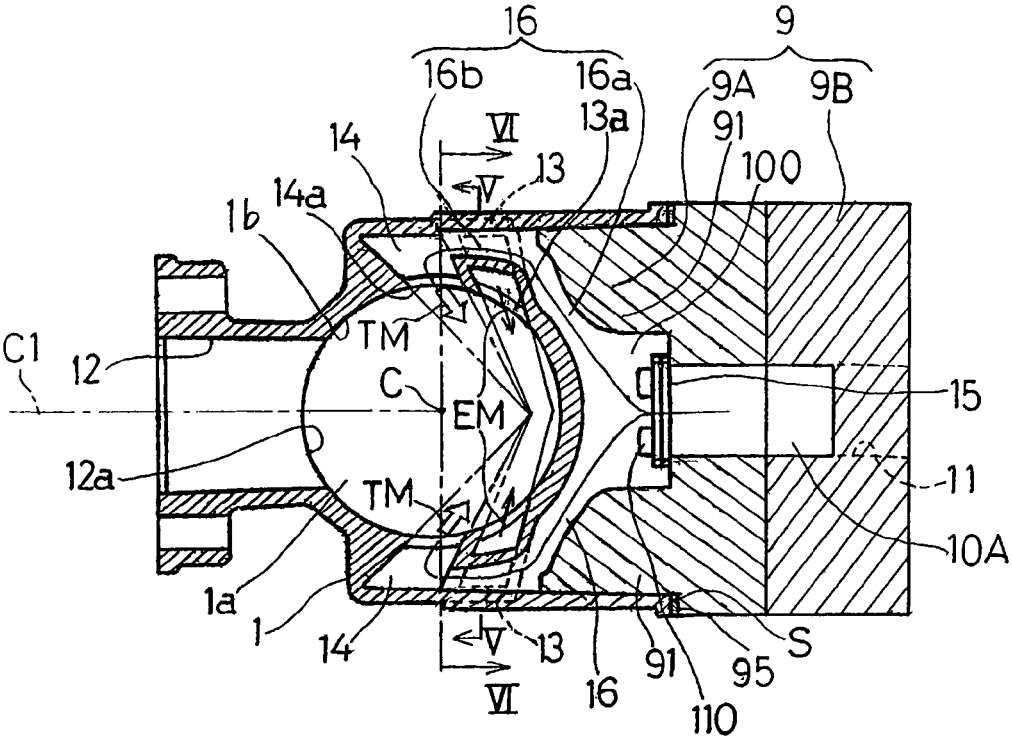
FIG. 3 is a cross-sectional view taken along the line III—III in FIG. 2.

As best shown in FIG. 3 showing the cross-sectional view taken along the line III-III in FIG. 2, the first scavenging passages 13 are so arranged and so positioned as to assume a symmetrical relation with each other with respect to a longitudinal axis C1 of the exhaust passage 12. Similarly, the second scavenging passages 14 are also so arranged and so positioned as to assume a symmetrical relation with each other with respect to the longitudinal axis C1 of the exhaust passage 12. In correspondence therewith, the first scavenging passages 13 has respective first scavenging ports 13*a* defined in the cylinder block 1 so as to open towards the cylinder bore 1*b* and positioned so as to assume a symmetrical relation with each other with respect to the longitudinal axis C1 of the exhaust passage 12, and the second scavenging passages 14 similarly has respective second scavenging ports 14*a* defined in the cylinder block 1 so as to open towards the cylinder bore 1*b* and positioned so as to assume a symmetrical relation with each other with respect to the longitudinal axis C1 of the exhaust passage 12.

Specifically, as shown in FIG. 2, the first and second scavenging passages 13*a* and 14*a* are so positioned relative to each other and also relative to the exhaust port 12*a* that the uppermost edge of each of the second scavenging ports 14*a* occupies a position higher than that of the respective first scavenging ports 13*a* and lower than that of the exhaust port 12*a*.

The lean air/fuel mixture TM introduced into the branch passage 10A within the insulator 9 can be once introduced into the second scavenging passages 14 through introducing passages 16 (FIG. 3), as will be described later, by the effect of a negative pressure developed within the crank chamber 2*a* during an intake stroke in which the piston 7 elevates. On the other hand, the air/fuel mixture EM supplied through the air/fuel mixture passage 11 can be directly introduced into the crank chamber 2*a* through a air/fuel mixture port 11*a*, defined in the inner peripheral surface of the cylinder block 1, by the effect of a negative pressure developed within the crank chamber 2*a* when the air/fuel mixture port 11*a* is opened as the piston 7 elevates.

Referring to FIG. 3, the introducing passages 16 referred to above and fluidly connecting the branch passage 10A within the insulator 9 with the second scavenging passages 14, respectively, are defined in the cylinder block 1 so as to define respective downstream regions of the branch passage 10A. The introducing passages 16 are formed in the cylinder block 1 so as to extend at respective locations radially outwardly of the first scavenging passages 13, so that the branch passage 10A can be communicated with the second scavenging passages 14 with no need to use any air supply tube and connecting tube, both of which have hitherto required in the conventional combustion engine of a similar kind.

The first insulator block 9A of the insulator 9 is formed integrally with a pair of protrusions 91 each forming a part of the wall surface defining the corresponding introducing passage 16. As show in FIG. 4 in a side view of the cylinder block 1, the cylinder block 1 has a recess 100 defined therein and delimited by the protrusions 91 while forming parts of the introducing passages 16. This recess 100 is formed in the cylinder block 1 simultaneously with the casting or molding of the cylinder block 1 by removing a portion of the casting die in a direction counter to the exhaust port 12*a*, that is, in a direction parallel to the branch passage 10A. This recess 100 can easily be formed by the use of a casting mold assembly of a simplified shape. With the protrusions 91 shown in FIG. 3 projecting into this recess 100, upstream regions 16*a* of the introducing passages 16 are thus defined.

Each of respective downstream regions 16*b* of the introducing passages 16 is defined by a deep region of the recess 100 with respect to the direction of flow of the lean air/fuel mixture TM and extends radially outwardly of the adjacent first scavenging passage 13 to the corresponding second scavenging passage 14. In other words, the recess 100 forms respective parts of the inner wall surfaces of the introducing passages 16 over the entire lengthwise direction of the introducing passages 16 (i.e., the direction of flow of the lean air/fuel mixture TM).

Figure 8:
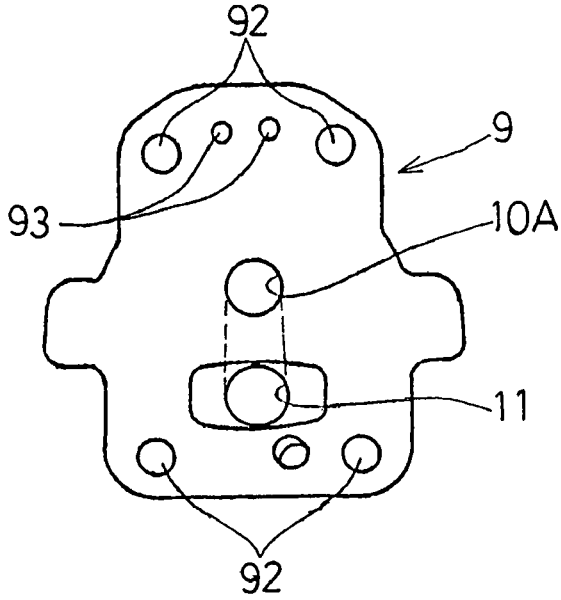
FIG. 8 is a front elevational view of a portion of the two-cycle internal combustion engine, showing an insulator as viewed from a side of the engine cylinder block.

As best shown in FIG. 8 showing the insulator 9 as viewed from a side of the cylinder block 1, in addition to the branch passage 10A and the air/fuel mixture passage 11 of a generally rectangular cross-sectional shape having a height and a transverse width both gradually decreasing towards the downstream side thereof, the insulator 9 is formed with four mounting holes 92 at four corner areas thereof and two reed valve mounting holes 93 for accommodating respective reed valves as will be described later.

As shown in FIG. 2, a downstream outlet end of the branch passage 10A in the insulator 9 is fitted with a reed valve 15 in the form of, for example, a check valve capable of permitting the lean air/fuel mixture TM to flow therethrough towards the second scavenging passage 14. This reed valve 15 is so operable that when the pressure inside the introducing passages 16 communicated with the branch passage 10A decreases down to a predetermined value or lower, the branch passage 10A can be closed by the reed valve 15. This reed valve 15 is fitted to the insulator 9 by aligning mounting holes (not shown), defined in the reed valve 15, with the mounting holes 93 in the insulator 9 (FIG. 8) and then threading corresponding screw members 110 into the mounting holes 93 through the mounting holes in the reed valve 15.

Figure 5:
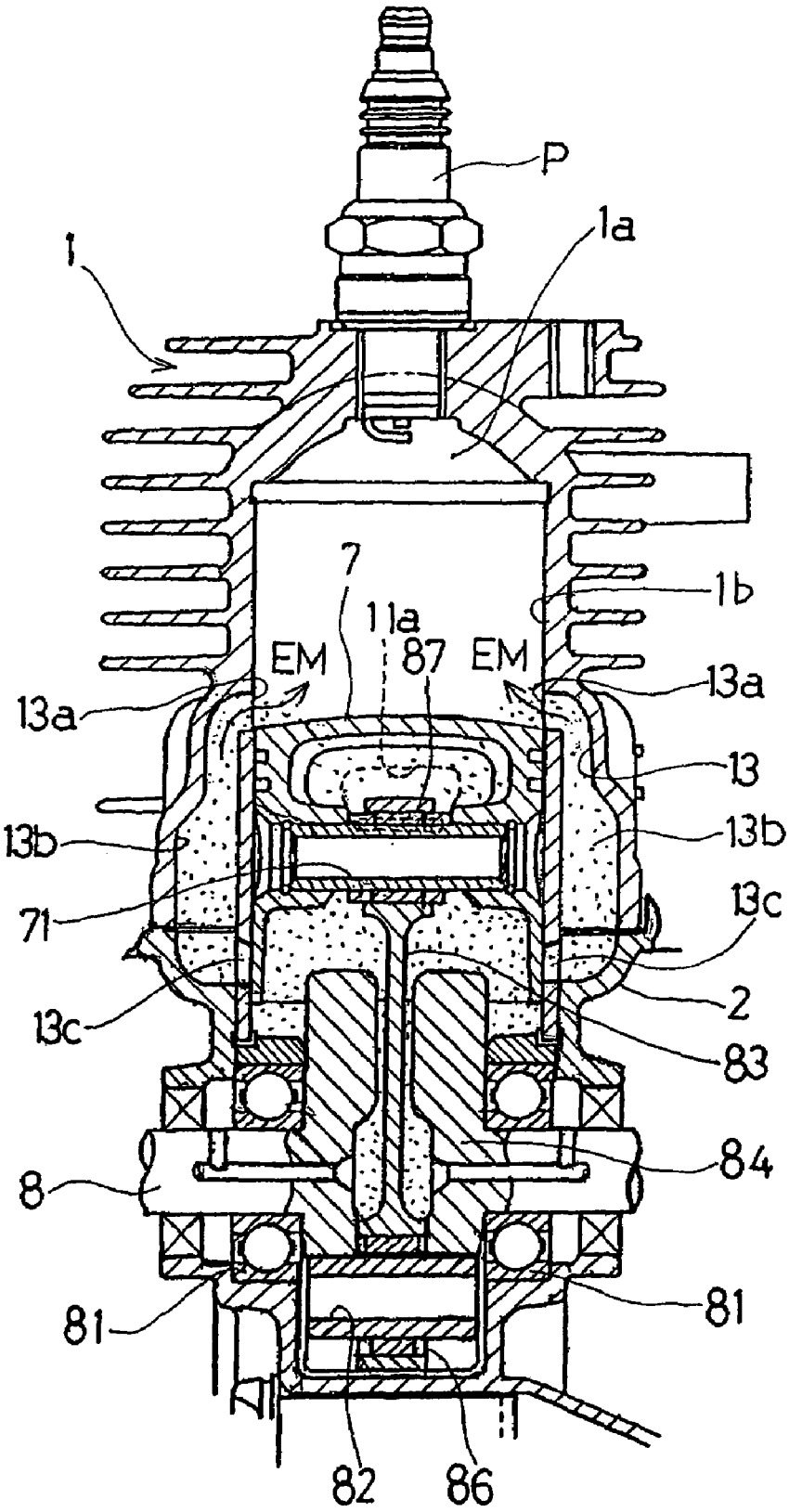
FIG. 5 is a cross-sectional view taken along the line V—V in FIG. 3, showing first scavenging passages.

Referring now to FIG. 5 showing a cross-sectional view taken along the line V—V in FIG. 3, each of the first scavenging passages 13 includes the first scavenging port 13*a* opening at the inner peripheral surface of the cylinder block 1, a generally vertically extending communicating passage 13*b* extending from the first scavenging port 13*a* to an upper portion of the crankcase 2 past a lower end of the cylinder block 1, and an inflow port 13*c* defined in the inner peripheral surface of the upper portion of the crankcase 2 so as to open towards the crank chamber 2*a*. The air/fuel mixture EM introduced from the air/fuel mixture passage 11 shown in FIG. 2 into the crank chamber 2*a* through the air/fuel mixture port 11*a* can be injected into the combustion chamber 1*a* from the first scavenging port 13*a* through the communicating passages 13*b* during the scavenging stroke in which the piston 7 descends as shown in FIG. 5.

Figure 6:
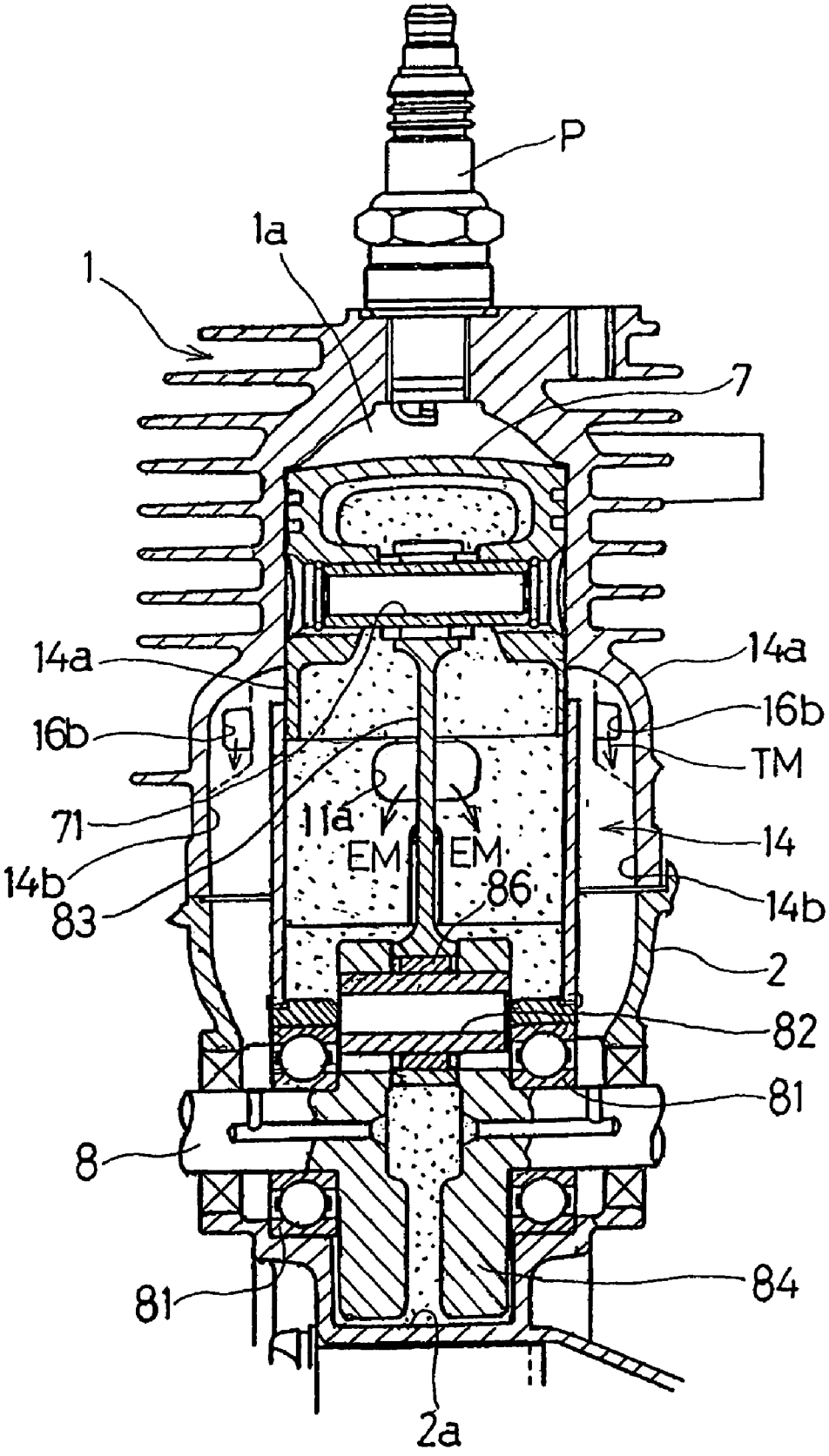
FIG. 6 is a cross-sectional view taken along the line VI—VI in FIG. 3, showing second scavenging passages during an intake stroke.

As shown in FIG. 6 showing the cross-sectional view taken along the line VI—VI in FIG. 3, each of the second scavenging passages 14 includes a second scavenging port 14*a* defined in the inner peripheral surface of the cylinder block 1, and a generally vertically extending communicating passage 14*b* extending from the second scavenging port 14*a* past the lower end of the cylinder block 1 to an outer side face of the corresponding crankshaft bearing 81, which is held at a location generally intermediate of the height of the crankcase 2. This communicating passage 14*b* has a lower end communicated with the crank chamber 2*a* through a gap between inner and outer races of the corresponding crankshaft bearing 81 and then through a gap between an associated crank web 84 and the corresponding crankshaft bearing 81. The lean air/fuel mixture TM introduced from the branch passage 10A shown in FIG. 3 into the second scavenging passages 14 can be injected into the combustion chamber 1*a* through the second scavenging ports 14*a* by way of the respective communicating passages 14*b* during the scavenging stroke in which the piston 7 descends.

As FIG. 4 makes it clear, a downstream region of the air/fuel mixture passage 11 is defined at a location below the recess 100 opening at an outer side portion of the cylinder block 1, with an outlet thereof defining the air/fuel mixture port 11*a* opening at the inner peripheral surface of the cylinder block 1. The outer side portion of the cylinder block 1 is in the form of a flat mounting seat S, onto which one end face of the insulator 9 of FIG. 8, which is of a shape substantially similar to the shape of the flat mounting seat S, is firmly mounted through a gasket 95 (FIG. 3). The firm mounting of the insulator 9 onto the flat mounting seat S is accomplished by a plurality of screw members (not shown) inserted through the mounting holes 92 in the insulator 9 and firmly threaded into corresponding screw holes 10*d* defined in the cylinder block 1 shown in FIG. 4.

The operation of the two-cycle combustion engine of the structure hereinabove described will now be described.

During the intake and compression stroke, as the piston 7 starts its ascending motion from the bottom dead center shown in FIG. 1, the negative pressure is developed inside the crank chamber 2*a* immediately after the first and second scavenging ports 13*a* and 14*a* are closed by the piston 7 then ascending towards the top dead center. This negative pressure inside the crank chamber 2*a* is propagated to the second scavenging passages 14 communicated with the crank chamber 2*a* through the crankshaft bearings 81 and is in turn propagated to the introducing passages 16 communicated with the respective second scavenging passages 14 and, as a result, the reed valve 15 fitted to the outlet of the branch passage 10A in the insulator 8 is opened.

At this time, since the air/fuel mixture EM supplied from the air/fuel mixture supply passage 3*a* in the carburetor 3 contains a substantial amount of fuels in the form of particles without being fully atomized, a large amount of inertia force is developed, allowing the air/fuel mixture EM to flow straightforward through the air/fuel mixture passage 11, which the mixture EM subsequently impinges upon an outer peripheral surface of the piston 7 then closing the air/fuel mixture port 11*a* of the air/fuel mixture passage 11, piling up at a location in the vicinity of the air/fuel port 11*a*. On the other hand, since opening of the reed valve 15 so effected in the manner described above allows a suction force from the introducing passages 16, then under negative pressure, to act in the branch passage 10A, the lean air/fuel mixture TM containing a slight amount of fuel can be drawn from the air/fuel mixture EM then flowing through the air/fuel mixture passage 11. In other words, the branch passage 10A acts to draw from the air/fuel mixture EM the lean air/fuel mixture TM which is lean of fuel as compared with the air/fuel mixture EM.

In particular, in the illustrated embodiment, the branch passage 10A is disposed above the air/fuel mixture passage 11, the gravity is also utilized in combination with the inertia force of the fuel particles contained in the air/fuel mixture EM to effectively separate the lean air/fuel mixture TM from the air/fuel mixture EM so that only the lean air/fuel mixture TM can be introduced into the branch passage 10A. It is, however, to be noted that since the air/fuel mixture EM flows straight with the great inertia force, the lean fuel/air mixture TM can be separated from the air/fuel mixture ME and is then introduced into the branch passage 10A even though the branch passage 10A and the air/fuel mixture passage 11 are so arranged and so positioned as to extend parallel to each other in horizontally side-by-side fashion.

The lean air/fuel mixture TM sucked into the branch passage 10A is once introduced into the second scavenging passages 14 through the introducing passages 16. Thus, when the reed valve 15 is opened by the effect of the negative pressure inside the crank chamber 2*a* as shown in FIG. 2 during the intake stroke with the piston 7 ascending, the lean air/fuel mixture TM is always introduced into the second scavenging passages 14. For this reason, a sufficient amount of the lean air/fuel mixture TM utilizable to avoid a blow-off can be reserved in respective upper regions (downstream regions) of the second scavenging passages 14.

When during the intake and compression stroke the piston 7 reaches near the top dead center with the air/fuel mixture port 11*a* opened consequently, the air/fuel mixture EM within the air/fuel mixture passage 11 is directly introduced through the air/fuel mixture port 11*a* into the crank chamber 2*a* then held under negative pressure. Hence, the crankshaft bearings 81, the large diameter end bearing 86, the small diameter end bearing 87 and other components can be effectively lubricated by the air/fuel mixture EM so introduced. Also, a portion of the air/fuel mixture EM introduced into the crank chamber 2*a* flows into respective lower end regions of the first and second scavenging passages 13 and 14.

Thereafter, when the piston 7 starts descending following the explosion of the air/fuel mixture having taken place within the combustion chamber 1*a*, the power and exhaust stroke (or power and exhaust stroke) begins and, therefore, the reed valve 15 is closed, the air/fuel mixture port 11*a* is also closed by the piston 7 then descending and the supply of the lean air/fuel mixture TM and the air/fuel mixture EM into the second scavenging passages 14 and the crank chamber 2*a* is interrupted. Subsequently, when as a result of further descending motion of the piston 7, the first and second scavenging ports 13*a* and 14*a* of the first and second scavenging passages 13 and 14, respectively, are successively opened, the lean air/fuel mixture TM is, as shown in FIG. 3 introduced into the combustion chamber 1*a* through the second scavenging ports 14*a* and, on the other hand, the air/fuel mixture EM is introduced into the combustion chamber 1*a* through the first scavenging ports 13*a*.

Considering that the first and second scavenging ports 13*a* and 14*a* are so positioned relative to each other that the second scavenging ports 14*a* can be opened by the piston 7, then descending towards the bottom dead center, earlier than the opening of the first scavenging ports 13*a*, introduction of the air/fuel mixture EM from the first scavenging ports 13*a* into the combustion chamber 1*a* takes place at a timing slightly delayed relative to introduction of the lean air/furl mixture TM form the second scavenging ports 14*a* into the combustion chamber 1*a*. Also, considering that the second scavenging ports 14*a* are positioned nearer to the exhaust port 12*a* than the first scavenging ports 13*a*, the lean air/fuel mixture TM is introduced into the combustion chamber 1*a* at a location closer to the exhaust port 12*a* than the location at which the air/fuel mixture EM is similarly introduced into the combustion chamber 1*a*. Accordingly, the successive opening of the second and first scavenging ports 14*a* and 13*b* that takes place in the manner described above results in that the lean air/fuel mixture TM early introduced into the combustion chamber 1*a* can block the subsequently introduced air/fuel mixture EM to thereby prevent the air/fuel mixture EM from being blown off through the exhaust port 12*a*. As a matter of course, following the introduction of the lean air/fuel mixture TM into the combustion chamber 1*a*, the air/fuel mixture EM is introduced into the combustion chamber 1*a* through the second scavenging ports 14*a*.

Figure 7:
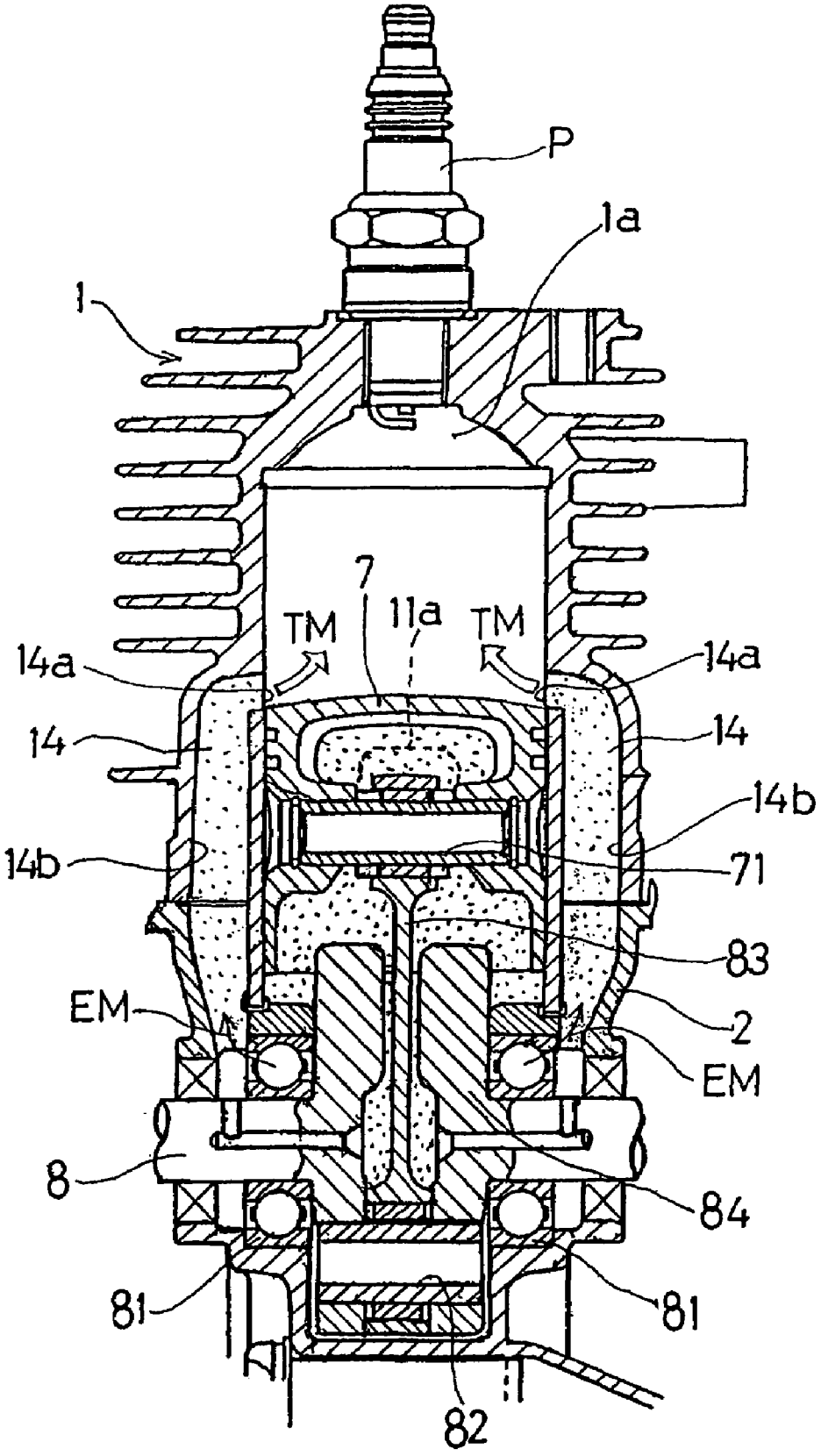
FIG. 7 is a cross-sectional view taken along the line VI—VI in FIG. 3, showing the second scavenging passages during a scavenging stroke.

When the lean air/fuel mixture TM is introduced into the combustion chamber 1*a* through the second scavenging passages 14 as shown in FIG. 7, a portion of the air/fuel mixture EM within the crank chamber 2*a* flows into the second scavenging passages 14 through the respective gaps between the inner and outer races of the crankshaft bearings 81 and, therefore, the crankshaft bearings 81 can be effectively lubricated with the fuel component contained in a large amount in the air/fuel mixture EM to thereby achieve a favorable lubrication of the crankshaft bearings 81.

Since this two-cycle combustion engine of the structure described hereinabove includes, particularly as shown in FIG. 1, the air/fuel mixture passage 11 and the branch passage 10A branched off from the air/fuel mixture passage 11 for introducing the lean air/fuel mixture TM into the second scavenging passages 14, the carburetor 3 which can be employed in combination with this particular two-cycle combustion engine may be of a simplified structure including the single air/fuel mixture supply passage 3*a*. Also, only one reed valve 15 can be employed in association with the branch passage 10A. Yet, since the branch passage 10A is fluidly connected with the second scavenging passages 14 through the respective introducing passages 16 defined in the cylinder block 1, neither the air supply tube nor the connecting tube, both of which have hitherto required in the conventional combustion engine of a similar kind, is needed in the two-cycle combustion engine any more. Those advantageous cumulative effects can bring about reduction in cost of manufacture of the two-cycle combustion engine.

Yet, since the second scavenging passages 14 is operable to introduce the lean air/fuel mixture TM into the combustion chamber 1*a*, rather than air hitherto employed in the conventional combustion engine of a similar kind, so as to accomplish a leading scavenging, there is less possibility that insufficient acceleration will occur, which has hitherto found in the conventional combustion engine in which the leading scavenging is carried out with air. Considering that the lean air/fuel mixture TM used for the leading scavenging can evolve a large latent heat of vaporization as compared with the air hitherto used in the conventional engine, not only can a high cooling effect be obtained relative to an upper region of the cylinder block 1, but also the fuel contained in the lean air/fuel mixture TM can be atomized by the effect of heat evolved in the cylinder block 1, resulting in increase of the efficiency of combustion.

It is, however, to be noted that although in the foregoing embodiment, the lean air/fuel mixture TM has been shown and described as introduced into the second scavenging passages 14, the lean air/fuel mixture TM may be introduced into both of the first and second scavenging passages 13 and 14. In such case, the air/fuel mixture EM introduced directly into the crank chamber 2*a* can flow into respective lower regions (upstream regions) of the first and second scavenging passages 13 and 14 and from those first and second scavenging passages 13 and 14 the lean air/fuel mixture TM will be injected, followed by injection of the air/fuel mixture EM to thereby accomplish a stratified scavenging.

Also, in the foregoing embodiment, one of the pair of the first scavenging passages 13 and the pair of the second scavenging passages 14 may be dispensed with, leaving only one pair of the scavenging passage. Even in this case, the lean air/fuel mixture TM can flow into the upper regions of the scavenging passages and, on the other hand, the air/fuel mixture EM introduced directly into the crank chamber 2*a* can flow into the lower regions of the scavenging passage and, therefore, the stratified scavenging, in which the lean air/fuel mixture TM and the air/fuel mixture EM can be supplied in a two layered fashion into the combustion chamber, can be accomplished.

Furthermore, although in the foregoing embodiment the second scavenging passages 14 have shown and described as having their lower end extended to respective outer side faces of the crankshaft bearings 81 so as to communicate with the crank chamber 2*a* through the gaps between the inner and outer races of the crankshaft bearings 81 and then through the gaps between the crank webs 84 and the crankshaft bearings 81, the lower ends of the second scavenging passages 14 may be so positioned as to directly communicate with the crank chamber 2*a* at a location above the crankshaft bearings 81.

Figure 9A:
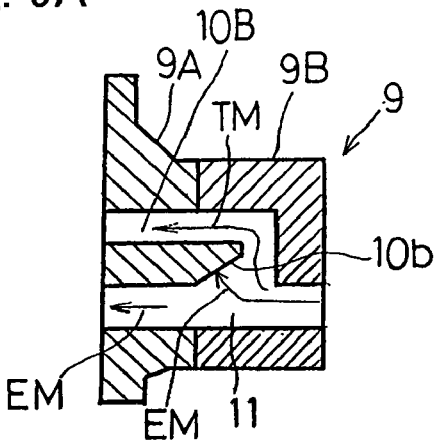
FIGS. 9A to 9C are schematic sectional views, showing various forms of the insulator used in the two-cycle internal combustion engine according to the present invention, respectively.
Figure 9B:
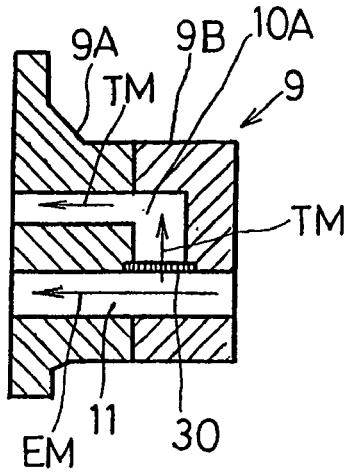
Figure 9C:
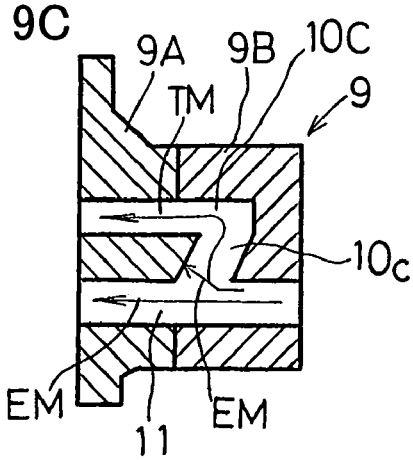

FIGS. 9A to 9C illustrate three different modifications of the insulator 9 referred to above, which can be employed in the practice of the present invention. In the modification shown in FIG. 9A, an inclined barrier wall 10*b* is defined in a portion of the partition wall, separating between the branch passage 10B and the air/fuel mixture passage 11, adjacent the point of ramification. This barrier wall 10*b* is so inclined and so operable that the air/fuel mixture EM then flowing straight within the air/fuel mixture passage 11 can collide against it to prevent the fuel particles of the air/fuel mixture from flowing into the branch passage 10B.

In the modification shown in FIG. 9B, the branch passage 10A of the same shape as that shown in and described in connection with the first embodiment has an inlet opening towards the air/fuel mixture passage 11, which inlet is provided with a mesh screen 30 for preventing the fuel particles of the air/fuel mixture from flowing into the branch passage 10A.

In the modification shown in FIG. 9C, an upstream portion 10*c* of the branch passage 10C immediately following the point of ramification from the air/fuel mixture passage 11 is so inclined as to extend slantwise in a direction (rightward direction as viewed therein) counter to the direction (leftward direction as viewed therein) of straight flow of the air/fuel mixture EM within the air/fuel mixture passage 11 to prevent the fuel particles of the air/fuel mixture from flowing into the branch passage 10C.

The two-cycle combustion engine according to a second preferred embodiment of the present invention will now be described with particular reference to FIGS. 10 to 12.

In the two-cycle combustion engine according to the second embodiment, the pair of protrusions 91 are formed integrally with the first insulator block 9A so as to protrude into the cylinder block 1 to define respective parts of the wall surfaces defining the corresponding introducing passages 16 in a manner similar to that shown and described with particular reference to FIG. 3, and further, lids 17 are fitted to opposite side faces of the cylinder block 1 so as to form respective parts of the wall surfaces defining the corresponding introducing passages 16.

Other structural features of the two-cycle combustion engine according to the second embodiment are similar to those shown in and described in connection with the first embodiment and, therefore, the details thereof are not reiterated for the sake of brevity.

The cylinder block 1 employed in the second embodiment includes, a first recess 100A communicated with the branch passage 10A through the reed valve 15 and second recesses 100B defined in the cylinder block 1 at respective locations radially outwardly of the pairs of the first and second scavenging passages 13 and 14 and opening outwardly of the cylinder block 1. The respective openings of the second recesses 100B are closed by the lids 17 to thereby form corresponding downstream regions 16*b* of the introducing passages 16.

Thus, the lean air/fuel mixture TM flowing from the branch passage 10A can be introduced into the second scavenging passages 14 through the introducing passages 16 and then through lean air/fuel mixture introducing ports 16*c* defined in the cylinder block 1 at a downstream end of the introducing passages 16, when the reed valve 15 is opened in a manner described in connection with the foregoing embodiment. The upstream regions 16*a* of the introducing passages 16 and the downstream regions 16*b* thereof are communicated with each other through respective communicating holes 10*a* defined in the cylinder block 1. In this way, the first and second recesses 100A and 100B form parts of the inner wall surfaces of the introducing passages 16 in an entire direction lengthwise of the introducing passages 16 (i.e., in an entire direction of flow of the mixture through the introducing passages 16). It is to be noted that the lean air/fuel mixture TM and the air/fuel mixture EM during the intake stroke and the scavenging stroke flow in respective manners as hereinbefore described in connection with the foregoing embodiment with reference to FIGS. 1 to 8 and, therefore, the details thereof are not reiterated for the sake of brevity.

Figure 4:
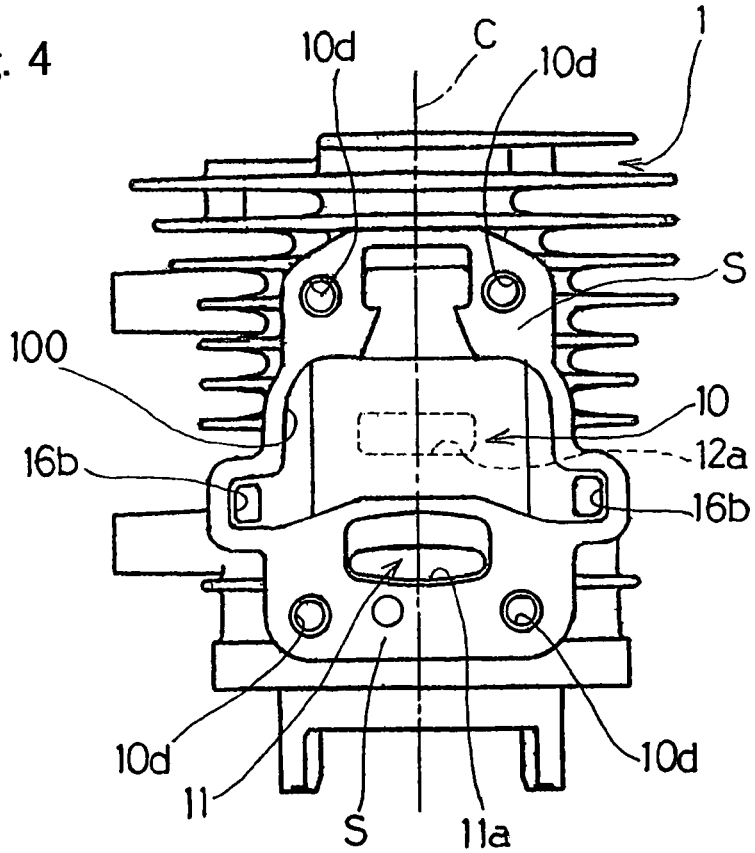
FIG. 4 is a side view of the two-cycle internal combustion engine, showing a cylinder block thereof.

The first recess 100A opening at an outer side of the cylinder block 1 and forming the upstream regions 16*a* which are respective parts of the introducing passages 16 has a transverse width smaller than that of the recess 100 employed in the previously described first embodiment, as best shown in FIG. 4, which forms the upstream and downstream regions 16*a* and 16*b* of the introducing passages 16. The lids 17 in FIG. 10 are fixed to front and rear side faces of the cylinder block 1 by means of screw members (not shown) with a gasket (also not shown) intervening between each lid 17 and the front or rear side face of the cylinder block 1. As compared with the previously described first embodiment, the second embodiment now under discussion is effective to allow the first recess 100A to have a reduced size and, therefore, as shown in FIG. 11 showing the cylinder block 1 with the lids 17 removed, the number of cooling fins 20 for air cooling the cylinder block 1 can advantageously be increased to enhance the efficiency of cooling of the cylinder block 1 by adding fins 20 on either side of the second recess 100B in FIG. 11.

Within each of the second recesses 100B defined in the cylinder block 1, in addition to the corresponding communicating hole 10*a*, the previously described lean air/fuel mixture introducing port 16*c* communicated with the respective second scavenging passage 14 is formed, with the downstream region 16*b* of the associated introducing passage 16 defined between the communicating hole 10*a* and the mixture introducing port 16*c*. Accordingly, the lean air/fuel mixture TM is introduced from the communicating holes 10*a* into the second scavenging passages 14 through the downstream regions 16*b* of the introducing passages 16 and the lean air/fuel mixture introducing port 16*c*.

Figure 10:
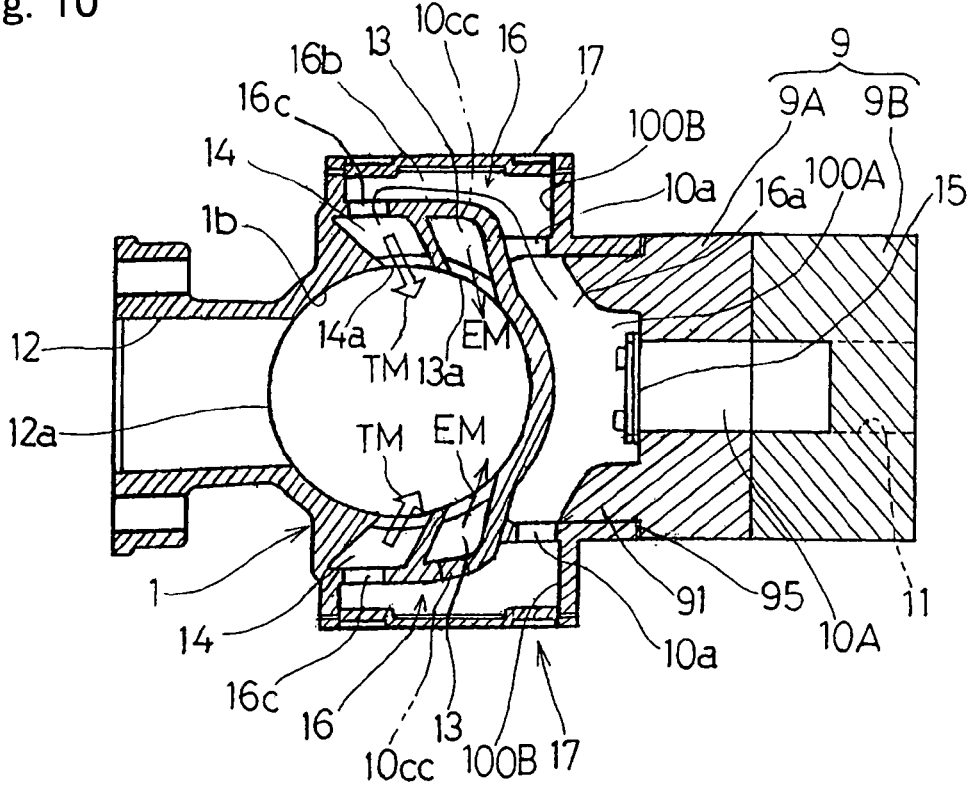
FIG. 10 is a view similar to FIG. 3, showing the two-cycle internal combustion engine according to a second preferred embodiment of the present invention.
Figure 11:
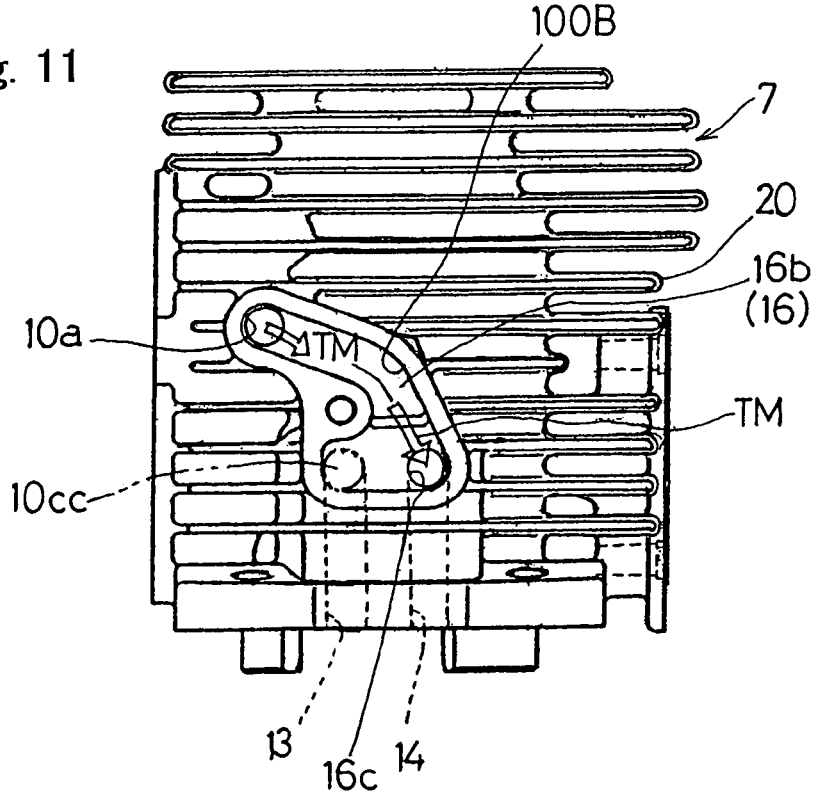
FIG. 11 is a side view of the two-cycle internal combustion engine shown in FIG. 10, showing the appearance of the cylinder block with lids removed.

It is, however, to be noted that where separate drawing ports 10*cc* are employed for communicating the first scavenging passages 13 with the introducing passages 16 as shown by the double-dotted lines in FIGS. 10 and 11, the lean air/fuel mixture TM can be sucked into not only the second scavenging passages 14, but also into the first scavenging passages 13. Accordingly, it is possible to allow the lean air/fuel mixture TM to be injected into the combustion chamber 1*a* through the second scavenging passages 14 at the initial timing at which not the rich air/fuel mixture EM but the lean air/fuel mixture TM is injected thereinto from the first scavenging passage 13 shown in FIG. 10 and, therefore, the blow-off of the air/fuel mixture EM subsequently injected into the combustion chamber 1*a* from the first and second scavenging passages 13 and 14 can further be suppressed effectively.

In the second embodiment described above, the introducing passages 16 are formed by the use of the lids 17 fitted to the cylinder block 1 so as to close the respective second recesses 110B in the cylinder block 1, in addition to the first recess 100A, formed by the casting used to form the cylinder block 1, and the protrusions 91 in the insulator 9. Accordingly, the second recesses 110B used to form the downstream regions 16*b* of the introducing passages 16, which are in particular positioned radially outwardly of the first scavenging passages 13 with respect to the cylinder block 1 can advantageously be formed by the use of a simplified casting mold assembly and, therefore, the cost of preparing the casting mold assembly can advantageously reduced.

Figure 12:
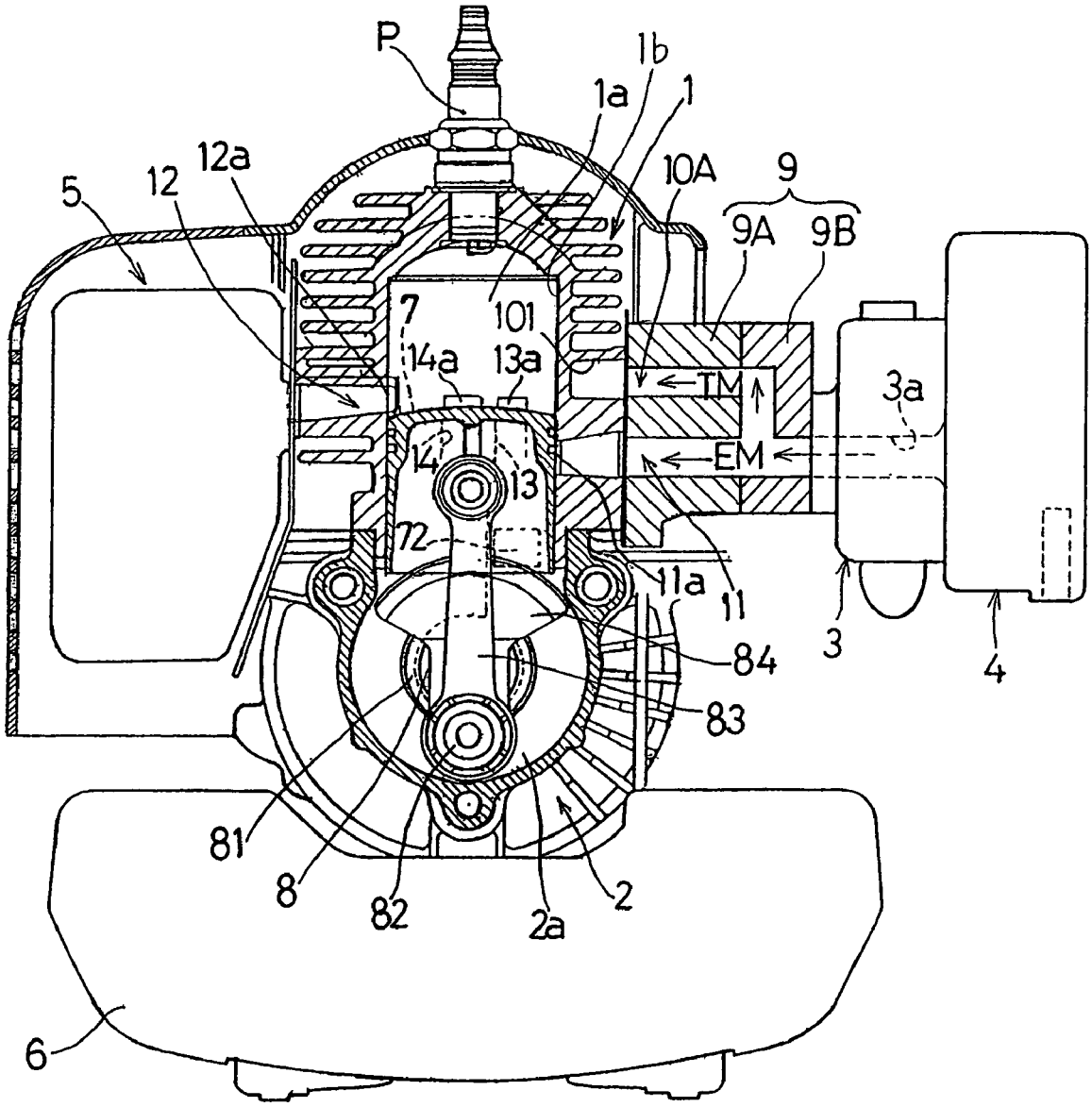
FIG. 12 is a transverse sectional view, with a portion cut out, of the two-cycle internal combustion engine according to a third preferred embodiment of the present invention.

FIG. 12 illustrates a transverse sectional view, with a portion cut out, of the two-cycle combustion engine according to a third preferred embodiment of the present invention. Referring now to FIG. 12, the two-cycle combustion engine shown therein is substantially similar to that according to the previously described first embodiment, except that in this third embodiment the use of the reed valve 15, required in the first embodiment, is dispensed with. Instead, arrangement has been made to allow the branch passage 10A to be communicated with the second scavenging ports 14*a* through respective intake chambers 72, each defined in the form of a recess in a corresponding side face of the piston 7, that is, in opposite portions of the outer peripheral surface of the piston 7 as will be described later in detail, when during the intake stroke the piston 7 nears the top dead center.

Other structural features of the two-cycle combustion engine according to the third embodiment are similar to those shown in and described in connection with the foregoing first embodiment and, therefore, the details thereof are not reiterated for the sake of brevity.

Figure 13:
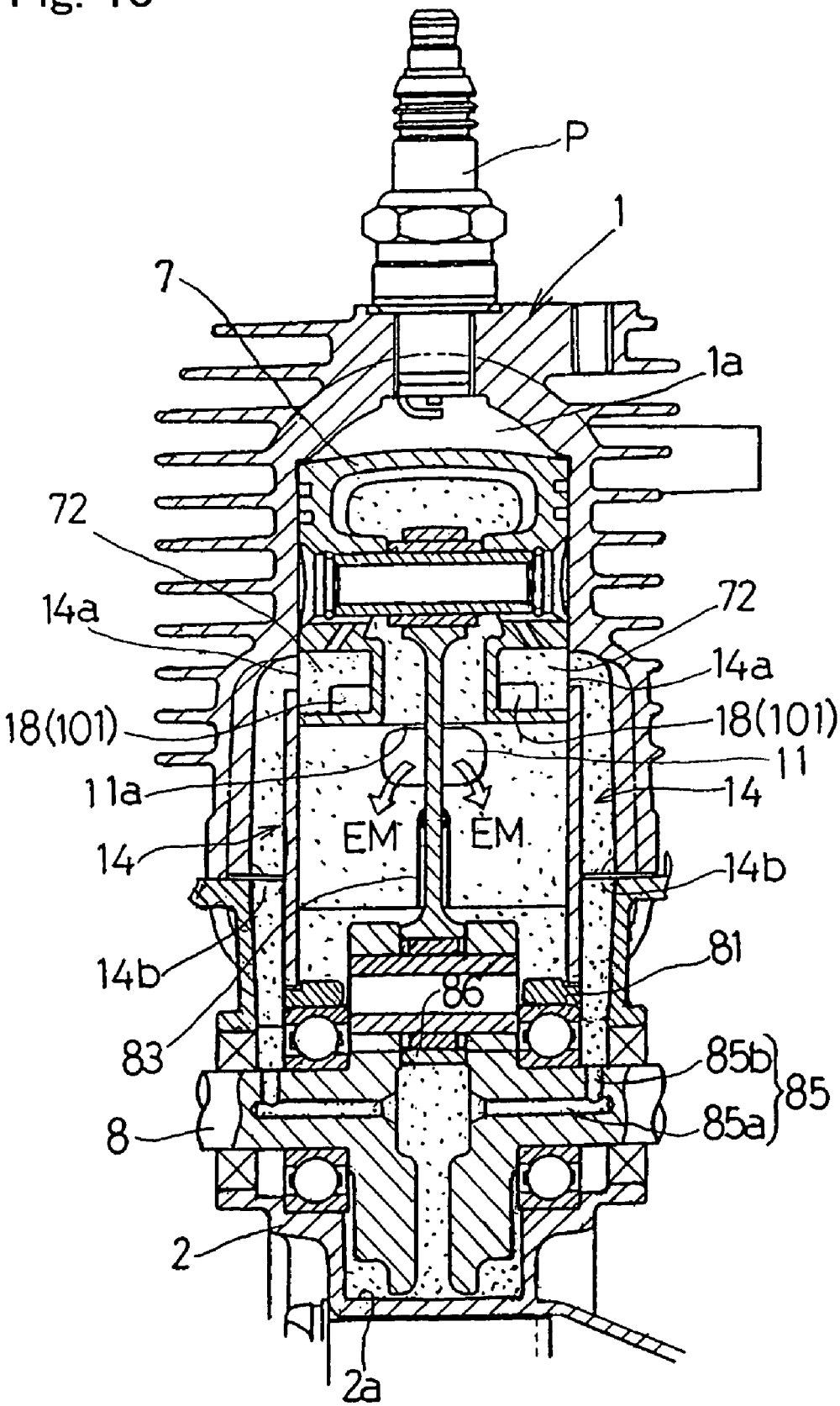
FIG. 13 is a longitudinal sectional view of the two-cycle internal combustion engine shown in FIG. 12, showing the engine cylinder and the crankcase with the second scavenging passages during the intake stroke.
Figure 14:
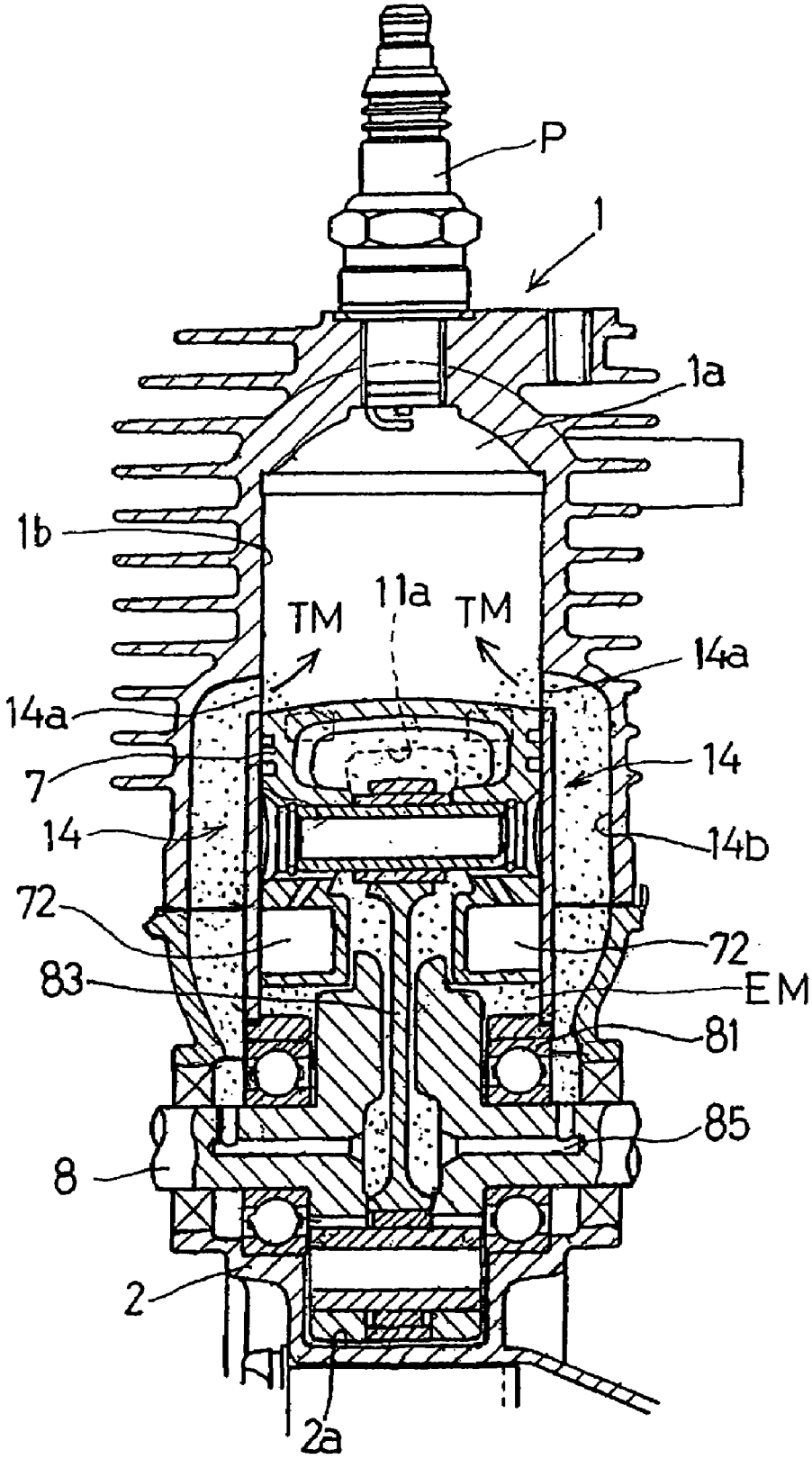
FIG. 14 is a longitudinal sectional view of the two-cycle internal combustion engine shown in FIG. 12, showing the engine cylinder and the crankcase with the second scavenging passages during the scavenging stroke.
Figure 15:
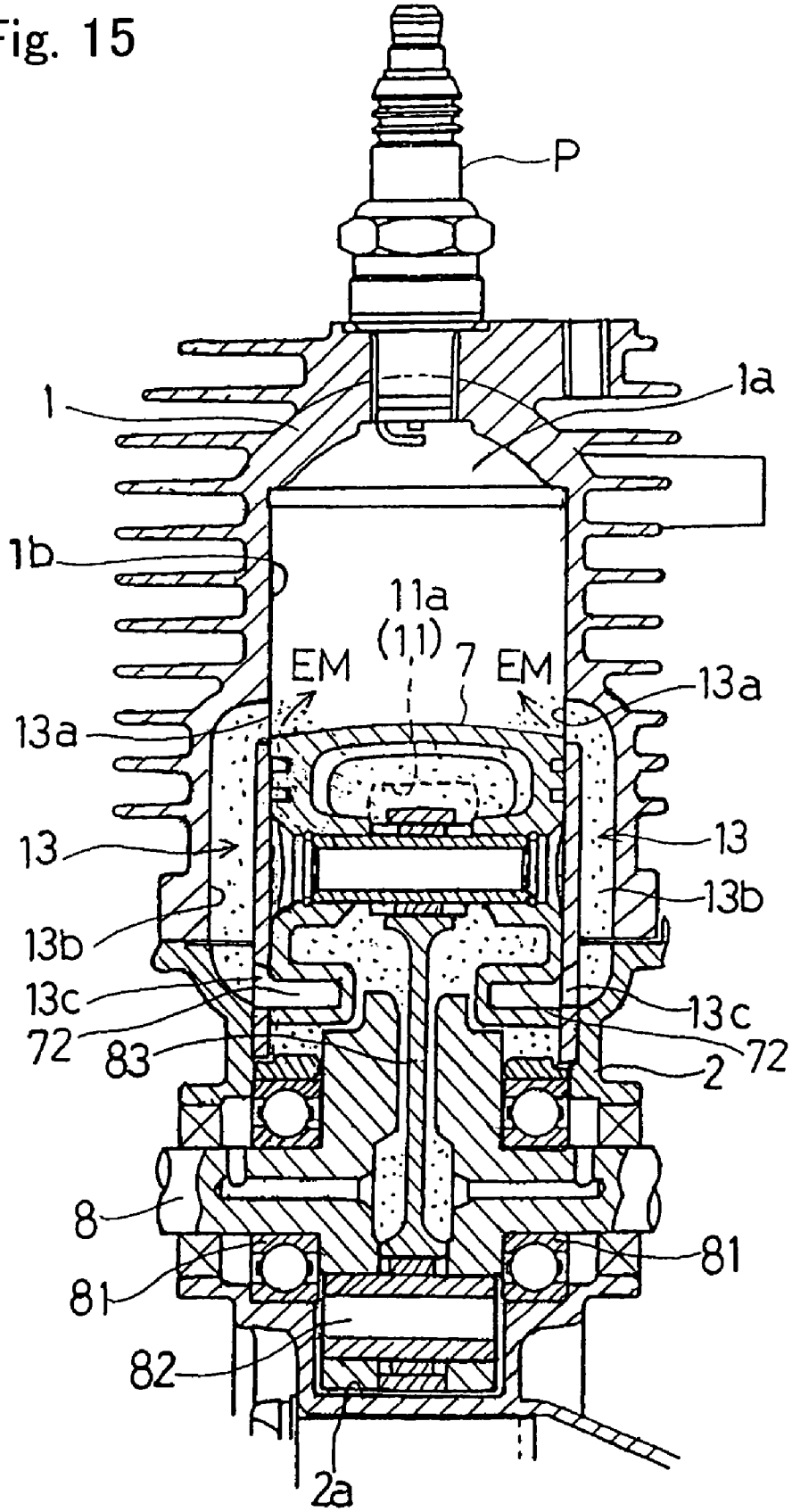
FIG. 15 is a longitudinal sectional view of the two-cycle internal combustion engine shown in FIG. 12, showing the first scavenging passages used therein.

FIGS. 13 to 15 are longitudinal sectional views of the two-cycle internal combustion engine according to the third embodiment, showing the engine cylinder and the crankcase on an enlarged scale. In particular, FIGS. 13 and 14 illustrate the second scavenging passages 14 and FIG. 15 illustrates the first scavenging passages 13. In any event, all of those figures illustrate the manner of flow of the air/fuel mixture EM and the lean air/fuel mixture TM with respect to the position of the piston 7.

As shown in FIG. 15, the two-cycle combustion engine shown therein is provided with the first scavenging passages 13 communicating directly between the combustion chamber 1*a* and the crank chamber 2*a*, which passages 13 extend in part within the cylinder block 1 and in part within the wall of the crankcase 2, and also with the second scavenging passages 14 communicating the combustion chamber 1*a* and the crank chamber 2*a* with each other through the crankshaft bearings 81 as shown in FIG. 13.

Each of the first scavenging passages 13 shown in FIG. 15 includes a first scavenging part 13*a* opening in the inner peripheral surface of the cylinder block 1, a generally vertically extending communicating passages 13*b* extending from the first scavenging port 13*a* to an upper portion of the crankcase 2 past a lower end of the cylinder block 1, and an inflow port 13*c* defined in the inner peripheral surface of the upper portion of the crankcase 3 so as to open towards the crank chamber 2*a*. The air/fuel mixture EM within the air/fuel mixture passage 11, shown in FIG. 13, can be introduced directly into the crank chamber 2*a* from the air/fuel mixture port 11*a* opening in the inner peripheral surface of the cylinder block 1, during the intake stoke with the piston 7 then ascending. The air/fuel mixture EM so introduced into the crank chamber 2*a* is injected into the combustion chamber 1*a* from the first scavenging ports 13*a* through the communicating passages 13*b* during the scavenging stroke with the piston 7 then descending as shown in FIG. 15.

The piston 7, when descending down to the bottom dead center, closes the inflow ports 13*c* shown in FIG. 15 by means of its peripheral wall to cut off the first scavenging passages 13 from the crank chamber 2*a*, thereby preventing the air/fuel mixture EM within the crank chamber 2*a* to flowing into the combustion chamber 1*a* through the first scavenging passages 13. Accordingly, introduction of the air/fuel mixture EM within the crank chamber 2*a* into the combustion chamber 1*a* at the last stage of the scavenging stroke can be effectively prevented and, therefore, the blow-off of the air/fuel mixture EM can advantageously be suppressed.

Also, as shown in FIG. 13, each of the second scavenging passages 14 includes a second scavenging port 14*a* opening in the inner peripheral surface of the cylinder block 1, and a generally vertically extending communicating passage 14*b* extending from the second scavenging port 14*a* past the lower end of the cylinder block 1 to an outer side face of the corresponding crankshaft bearing 81, which is held at a location generally intermediate of the height of the crankcase 2. The lean air/fuel mixture TM introduced from the branch passage 10A into the second scavenging passages 14 through a fluid circuit as will be described later can be injected into the combustion chamber 1*a* through the second scavenging ports 14 by way of the respective communicating passages 14*b* during the scavenging stroke as shown in FIG. 14.

Figure 16:
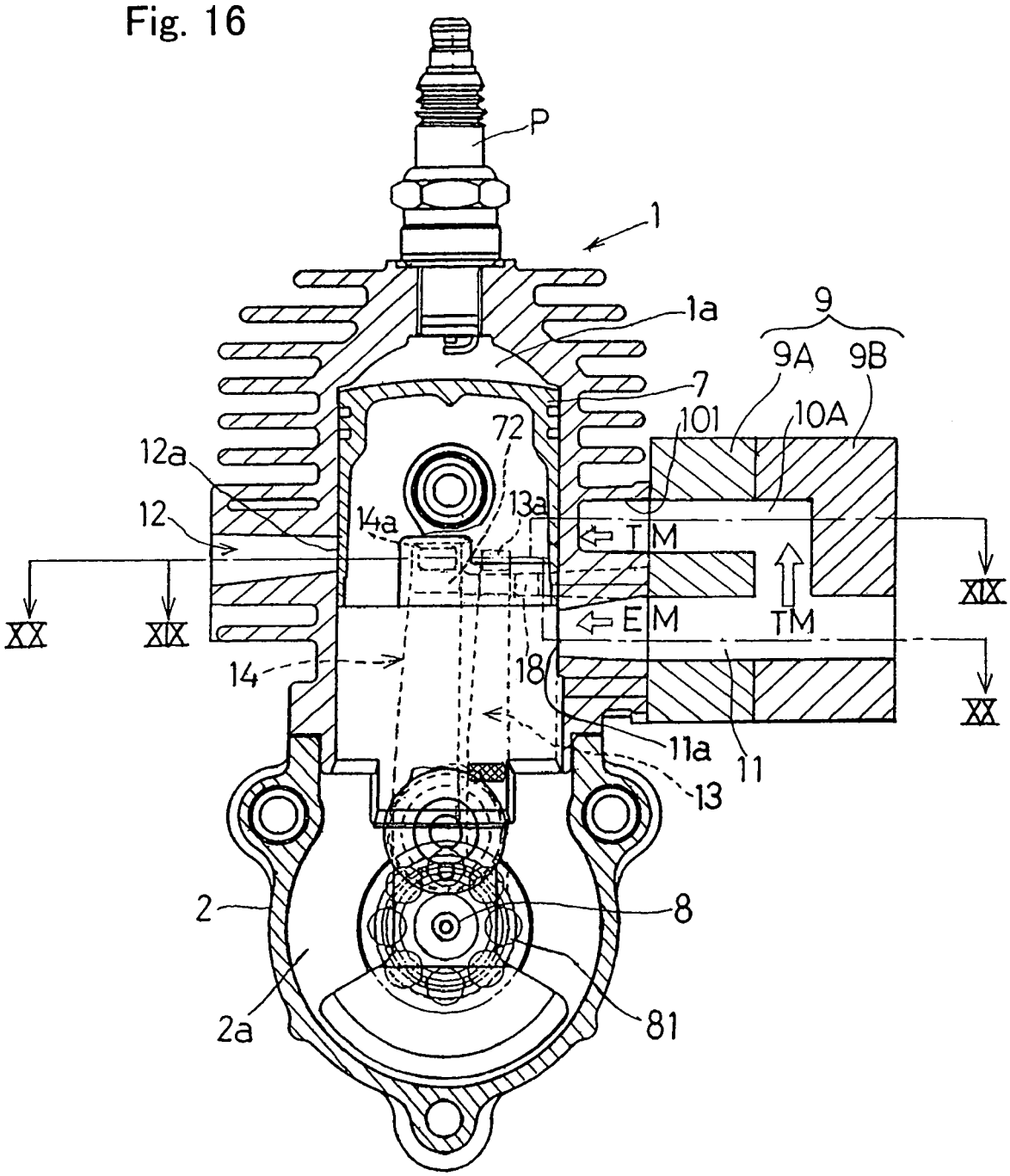
FIG. 16 is a transverse sectional view of the two-cycle internal combustion engine shown in FIG. 12, showing the engine cylinder and the crankcase shown on an enlarged scale.
Figure 17:
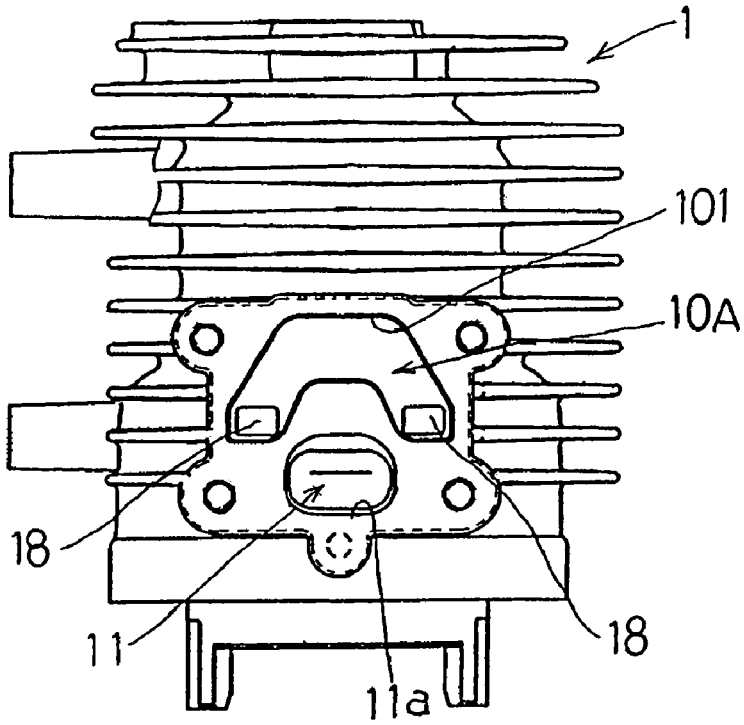
FIG. 17 is a side view of the cylinder block of the two-cycle internal combustion engine shown in FIG. 12, showing the appearance thereof.

FIG. 16 illustrates, on an enlarged scale, a portion of FIG. 12 and FIG. 17 illustrates a side view showing the appearance of the cylinder block 1. As shown in FIG. 17, an outer side portion of the cylinder block 1 is formed with a cutout 101 of a generally inverted V-shape, which forms a part of the downstream region of the branch passage 10A. Also, the cylinder block 1 is formed with two lean air/fuel mixture introducing ports 18 defined in deep areas of opposite side portions of the cutout 101, which ports 18, when the piston 7 shown in FIG. 16 reaches the top dead center, communicate with a suction chamber 72 defined in a side face, that is, a portion of the outer peripheral surface of the piston 7. Also, an air/fuel mixture port 11*a* opening in the inner peripheral surface of the cylinder block 1 and communicating with the air/fuel mixture passage 11 is defined at a position below the cutout 101.

Figure 18:
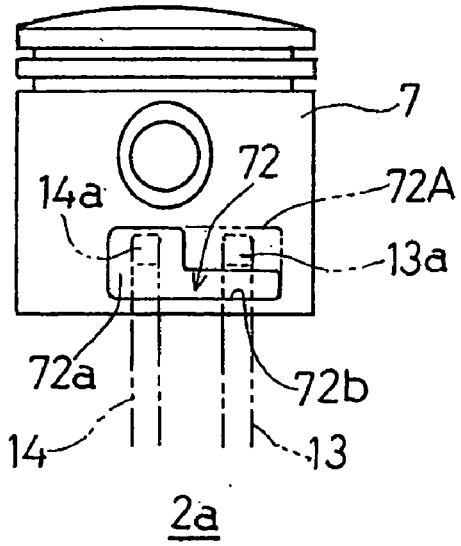
FIG. 18 is a schematic front elevational view, showing a piston employed in the two-cycle internal combustion engine shown in FIG. 12.

Referring now to FIG. 18 illustrating a front elevational view of the piston 7, a lower portion of the peripheral wall of the piston 7 is formed with the suction chamber 72 of a generally L-shaped configuration made up of a generally rectangular cavity 72*a* and an elongated groove 72*b* continued from the cavity 72*a* so as to extend in a direction circumferentially of the piston 7.

Figure 19:
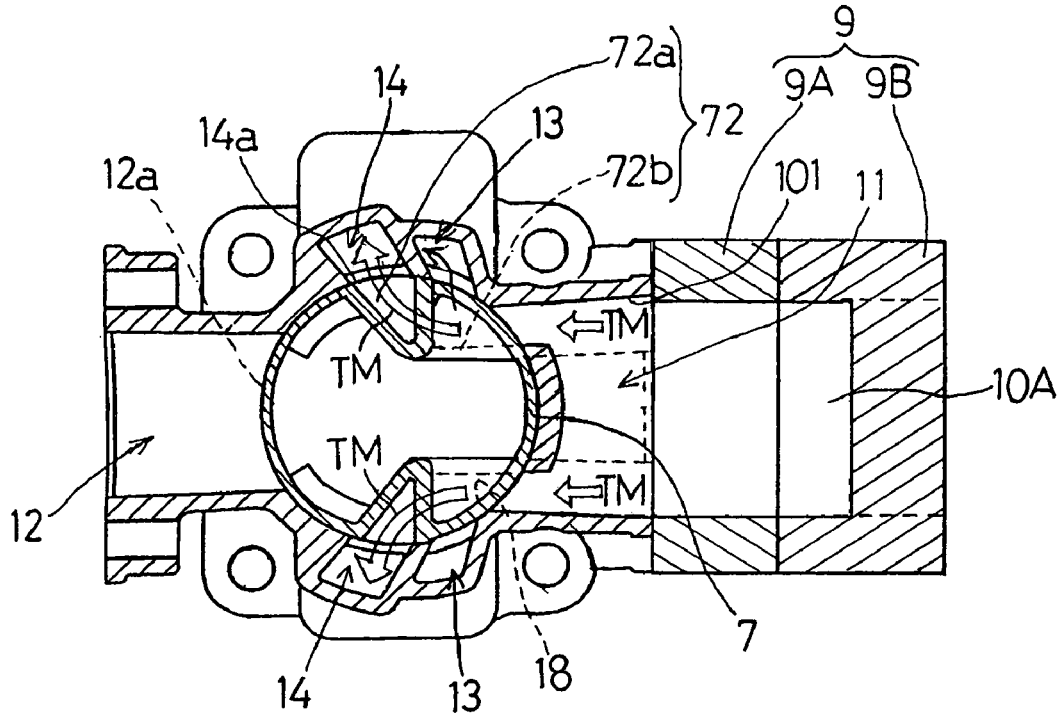
FIG. 19 is a cross-sectional view taken along the line XIX—XIX in FIG. 16.
Figure 20:
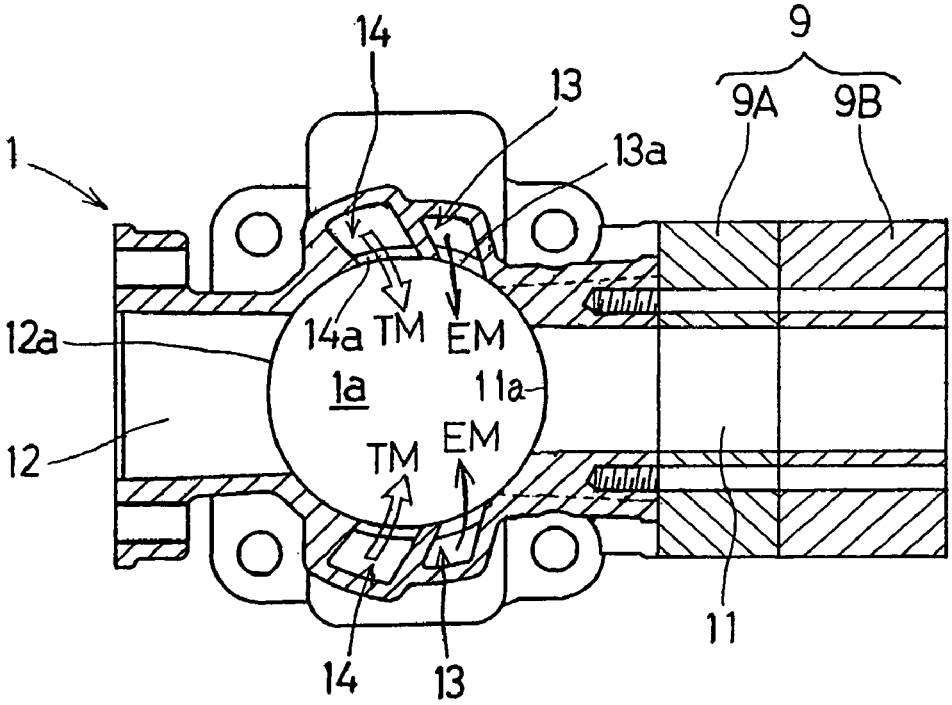
FIG. 20 is a cross-sectional view taken along the line XX—XX in FIG. 16.

FIG. 19 illustrates the cross-section taken along the line XIX—XIX in FIG. 16 and FIG. 20 illustrates the cross-section taken along the line XX—XX in FIG. 16. As clearly shown in FIG. 19, the suction chamber 72 of the shape described hereinabove is defined in a pair in the peripheral wall of the piston 7.

Specifically, the suction chamber 72 in the form of a depression in the peripheral wall of the piston 7 is formed in opposite front and rear portions of the peripheral wall of the piston 7. When the piston 7 nears the top dead center, respective portions of the circumferentially extending grooves 72*b* of the suction chambers 72 are aligned with the associated air/fuel mixture inflow ports 18 in the cutout 101 so that the lean air/fuel mixture TM introduced from the branch passage 10A into the cutout 101 can be introduced from the air/fuel mixture inflow ports 18 to the second scavenging ports 14*a* of the second scavenging passages 14 through the circumferentially extending grooves 72*b* and the cavities 72*a* of the suction chambers 72 and then into the second scavenging passages 14.

As hereinabove described, since the branch passage 10A is so constructed as to communicate with the second scavenging passages 14 through the air/fuel mixture inflow ports 18 and the suction chambers 72 only when the piston 7 nears the top dead center as shown in FIG. 16, such reed valve 15 as required in the previously described first embodiment can advantageously be dispensed with. Also, during the scavenging stroke in which the piston 7 descends, the leading scavenging of the combustion chamber 1*a* is carried out by the utilization of the lean air/fuel mixture TM injected from the second scavenging passages 14*a* as shown in FIG. 20 and, subsequently, the combustion chamber 1*a* is further scavenged by the air/fuel mixture EM injected from the first scavenging ports 13*a*.

The two-cycle combustion engine of the structure shown and described in connection with the third embodiment of the present invention operates in the following manner.

During the intake stroke, as the piston 7 starts its ascending motion from the bottom dead center shown in FIG. 12 accompanied by opening of the air/fuel mixture port 11*a* in the cylinder block 1, the air/fuel mixture EM within the air/fuel mixture passage 11 is introduced from the air/fuel mixture port 11*a* directly into the crank chamber 2*a*. The crankshaft bearings 81 and the crank pins 82 are effectively lubricated by the air/fuel mixture EM so introduced, in a manner with a simple structure similar to that described in connection with the first embodiment of the present invention.

Also, during the intake stroke, by the effect of the negative pressure developed inside the crank chamber 2*a*, the lean air/fuel mixture TM within the branch passage 10A is introduced. When the piston 7 nears the top dead center, the suction chambers 72 defined in the peripheral wall of the piston 7 are communicated with the air/fuel mixture intake ports 18 in the cylinder block 1. The lean air/fuel mixture TM within the branch passage 10A is consequently introduced into the second scavenging passages 14 and the crank chamber 2*a* through the second scavenging ports 14*a* by way of the air/fuel mixture intake port 18.

In this way, since the lean air/fuel mixture TM is introduced into the second scavenging passages 14 while the air/fuel mixture EM is being introduced into the crank chamber 2*a*, the lean air/fuel mixture TM can be introduced into the branch passage 10A, after having been separated by the effect of the inertia force from the air/fuel mixture EM then flowing through the air/fuel mixture passage 11 under the influence of a suction force, induced by the negative pressure inside the crank chamber 2*a*, while accompanying the strong inertia force. Accordingly, the further lean air/fuel mixture TM which is further lean as compared with that in the previously described first embodiment can advantageously be separated from the air/fuel mixture EM.

Thereafter and during the subsequent scavenging stroke shown in FIG. 14, the air/fuel mixture port 11 is closed and the first and second scavenging ports 13*a* and 14*a* of the first and second scavenging passages 13 and 14, respectively are also closed by the piston 7 then descending from the top dead center towards the bottom dead center, with the air/fuel mixture EM and the lean air/fuel mixture TM consequently injected into the combustion chamber 1*a* through the first and second scavenging ports 13*a* and 14*a*, respectively, as shown in FIG. 20. At this time, injection of the lean air/fuel mixture TM into the combustion chamber 1*a* through the second scavenging ports 14*a* takes place, followed by the injection of the air/fuel mixture EM into the combustion chamber 1*a* through the first scavenging ports 13*a* since the second scavenging ports 14*a* are opened by the piston 7 earlier than the first scavenging ports 13*a*. Thus, the lean air/fuel mixture TM injected prior to the air/fuel mixture EM acts to suppress the blow-off of the air/fuel mixture EM through the exhaust port 12*a*.

Also, considering that the second scavenging ports 14*a* are positioned nearer to the exhaust port 12*a* than the first scavenging ports 13*a*, the lean air/fuel mixture TM is introduced into the combustion chamber 1*a* at a location closer to the exhaust port 12*a* than the location at which the air/fuel mixture EM is similarly introduced into the combustion chamber 1*a*. Accordingly, the lean air/fuel mixture TM introduced from the second scavenging ports 14 can block the air/fuel mixture EM introduced from the first scavenging ports 13 to thereby effectively prevent the air/fuel mixture EM from being blown off through the exhaust port 12*a*. When the lean air/fuel mixture TM is injected from the second scavenging passages 14 shown in FIG. 14 into the combustion chamber 1*a*, a portion of the air/fuel mixture within the crank chamber 2*a* can flow into the second scavenging passages 14 through the gaps between the inner and outer races of the crankshaft bearings 81 and, therefore, the fuel contained in the air/fuel mixture EM can effectively be utilized to lubricate the crankshaft bearings 81.

In the third embodiment of the present invention described above, oil supply passages 85 are formed for communicating between the crank chamber 2*a* and the second scavenging passages 14 through the hollow of the crankshaft 8 as shown in FIG. 13. Each of those oil supply passages 85 includes a first oil passage 85*a* extending axially of the crankshaft 8 so as to open towards the crank chamber 2*a*, and a second oil passage 85*b* extending radially of the crankshaft 8 so as to communicate between the respective first oil passage 85*a* and the adjacent second scavenging passage 14. The use of the oil supply passages 85 described above is effective to allow a portion of the air/fuel mixture EM to flow from the crank chamber 2*a* into the oil supply passages 85 to effectively lubricate the large diameter end bearing 86.

In the two-cycle combustion engine according to the third embodiment of the present invention, as is the case with that according to the previously described first embodiment, the provision is made of the air/fuel mixture passage 11 shown in FIG. 12 and the branch passage 10A branched off from the air/fuel mixture passage 11 so as to allow the lean air/fuel mixture TM to be introduced into the second scavenging passages 14 and, therefore, the carburetor 3 that can be employed in combination therewith may be of a simple structure having only the single air/furl mixture supply passage 3*a*. Also, since the branch passage 10A is fluidly connected with the second scavenging passages 14 through the cutout 101, formed in the cylinder block 1, and the suction chambers 72 defined in the peripheral wall of the piston 7, neither the air supply tube nor the connecting tube, both of which have hitherto required in the conventional combustion engine of a similar kind, is needed and, also, no reed valve 15 (FIG. 1) such as required in the previously described first embodiment is needed, resulting in simplification of the structure and reduction in cost of manufacture of the two-cycle combustion engine.

Again, as is the case with the previously described first embodiment, as compared with the conventional two-cycle combustion engine, in which the leading scavenging is carried out with air, not only can the accelerating performance be increased, but a relatively high effect of cooling the upper region of the cylinder block 1 and the efficiency of combustion can also be increased due to the lean air/fuel mixture TM being atomized by the utilization of heats evolved from the cylinder block 1.

It is to be noted that if each of the suction chambers formed in the piston 7 is of a size sufficient to encompass both of the associated first and second scavenging ports 13*a* and 14*a* as shown by the double dotted line 72A in FIG. 18, the lean air/fuel mixture TM can be supplied into both of the first and second scavenging passages 13 and 14. In such case, the air/fuel mixture EM introduced directly into the crank chamber 2*a* can flow into respective lower regions of the first and second scavenging passages 13 and 14 and from those first and second scavenging ports 13*a* and 14*a* the lean air/fuel mixture TM will be injected, followed by injection of the air/fuel mixture EM to thereby accomplish a stratified scavenging.

Also, even in the third embodiment of the present invention, one of the pair of the first scavenging passages 13 and the pair of the second scavenging passages 14 may be dispensed with, leaving only one pair of the scavenging passage. Even in this case, the lean air/fuel mixture TM can flow into the upper regions of the scavenging passages and, on the other hand, the air/fuel mixture EM introduced directly into the crank chamber 2*a* can flow into the lower regions of the scavenging passage, accomplishing the stratified scavenging.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A two-cycle combustion engine which comprises:

at least one scavenging passage communicating between a combustion chamber and a crank chamber separated by a piston;

a fuel supply device having a valve for adjusting a cross-sectional area of an air/fuel mixture supply passage thereof;

an air/fuel mixture passage connected to and downstream from the fuel supply device for introducing an air/fuel mixture from the fuel supply device to the crank chamber; and a branch passage ramified off from the air/fuel mixture passage for supplying a lean air/fuel mixture, which is lean as compared with the air/fuel mixture in the air/fuel mixture passage, into the scavenging passage;

wherein during an intake stroke of the engine, the lean air/fuel mixture from the branch passage is introduced into the scavenging passage and the air/fuel mixture is introduced from the air/fuel mixture passage into the crank chamber; and wherein during a scavenging stroke of the engines the lean air/fuel mixture is supplied from the scavenging passage into the combustion chamber prior to introduction of the air/fuel mixture within the crank chamber into the combustion chamber through the scavenging passage.

2. The two-cycle combustion engine as claimed in claim 1, further comprising a check valve disposed in the branch passage for permitting only flow of the lean air/fuel mixture therethrough towards the scavenging passage.

3. The two-cycle combustion engine as claimed in claim 2, wherein a downstream region of the branch passage delimited by the check valve is formed in a cylinder block.

4. The two-cycle combustion engine as claimed in claim 1, wherein the piston has a peripheral wall farmed with a suction chamber and wherein during the intake stroke the suction chamber is communicated with the branch passage to allow the lean air/fuel mixture to be introduced from the branch passage into the scavenging passage through the suction chamber.

5. The two-cycle combustion engine as claimed in claim 1, wherein the scavenging passage is employed in two pairs and the branch passage is fluidly connected with one of die pairs of the scavenging passages.

6. The two-cycle combustion engine as claimed in claim 5, wherein the two pairs of the scavenging passages include a pair of first scavenging passages and a pair of second scavenging passage, wherein the second scavenging passages are positioned at respective locations closer to n exhaust port than the first scavenging passages and wherein the branch passage is fluidly connected with the pair of the second scavenging passages.

7. The two-cycle combustion engine as claimed in claim 1, wherein the branch passage is branched off from the air/fuel mixture passage so as to extend in a direction substantially perpendicular to the air/fuel mixture passage.

8. The two-cycle combustion engine as claimed in claim 1, wherein the fuel supply device includes a single air/fuel mixture supply passage for supplying the air/fuel mixture into the air/fuel mixture passage.

9. The two-cycle combustion engine as claimed in claim 1, wherein the branch passage is disposed above the air/fuel mixture passage.

10. The two-cycle combustion engine as claimed in claim 1 further including an inclined barrier wall as a portion of the branch passage to enable a collision of the air,fuel mixture to separate fuel particles and provide a leaner air/fuel mixture to enter the branch passage compared to the air/fuel mixture from the fuel supply device.

11. The two-cycle combustion engine as claimed in claim 1, further including a mesh screen in the branch passage for limiting fuel particles from flowing into the branch passage.

12. A two-cycle combustion engine which comprises:

at least one scavenging passage communicating between a combustion chamber and a crank chamber separated by a piston;

a fuel supply device having a valve for adjusting a cross-sectional area of an and/fuel liquid mixture supply passage thereof to provide air/fuel liquid mixture with inertial forces directly along a first axis;

an air/fuel liquid mixture passage connected with the fuel supply device and aligned with the first axis for introducing an air/fuel mixture from the fuel supply device to the crank chamber; and a branch passage positioned above and ramified off from the air/fuel liquid mixture passage a: an approximately perpendicular initial direction to the first axis flow direction of the air/fuel mixture passage, downstream of the fuel supply device valve, to provide a lean air/fuel liquid mixture, which is lean as compared with the air/fuel liquid mixture in the air/the mixture passage due to die inertial forces of the liquid fuel compared to the air flow, into the scavenging passage;

wherein dining an intake stroke of the engine, the lean air/fuel mixture from the branch passage is introduced into the scavenging passage and the air/fuel mixture is introduced from the air/fuel mixture passage into the crank chamber; and wherein during a scavenging stroke of the engine, the lean air/fuel mixture is supplied from the scavenging passage into the combustion chamber prior to introduction of the air/fuel mixture within the crank chamber into the combustion chamber trough the scavenging passage.

13. The two-cycle combustion engine as claimed in claim 12 further including a mesh screen in the branch passage fur limiting fuel particles from flowing into the branch passage.

14. A two-cycle combustion engine which comprises:

at least one scavenging passage communicating between a combustion chamber and a crank chamber separated by a piston having a side peripheral wall suction chamber;

a fuel supply device having a valve for adjusting a cross-sectional area of an air/fuel mixture supply passage thereof;

an air/fuel mixture passage connected with the fuel supply device for introducing an air/fuel mixture from the fuel supply device to the crank chamber; and a brunch passage ramified off from the air/fuel mixture passage for supplying a lean air/fuel mixture, which is lean as compared with the air/fuel mixture in the air/fuel mixture passage, into the scavenging passage, the branch passage communicates with the piston suction chamber during an intake stoke of the piston;

wherein during an intake stroke of the engine, the lean air/fuel mixture from the branch passage is introduced into the scavenging passage and the air/fuel mixture is introduced from the air/fuel mixture passage into the crank chamber; and wherein during a scavenging stroke of the engine, the lean air/fuel mixture is supplied from the scavenging passage into the combustion chamber prior to introduction of the air/fuel mixture within the crank chamber into the combustion chamber through the scavenging passage.

* * * * *